US010261449B2

(12) United States Patent
Nieda

(10) Patent No.: US 10,261,449 B2
(45) Date of Patent: Apr. 16, 2019

(54) DRIVE TRANSMISSION DEVICE AND IMAGE FORMING APPARATUS INCORPORATING THE DRIVE TRANSMISSION DEVICE

(71) Applicant: Hiroaki Nieda, Kanagawa (JP)

(72) Inventor: Hiroaki Nieda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/970,120

(22) Filed: May 3, 2018

(65) Prior Publication Data

US 2018/0329339 A1 Nov. 15, 2018

(30) Foreign Application Priority Data

May 11, 2017 (JP) ..... 2017-094977

(51) Int. Cl.

| | |
|---|---|
| ***G03G 15/00*** | (2006.01) |
| ***G03G 15/16*** | (2006.01) |
| ***G03G 15/04*** | (2006.01) |
| ***G03G 15/20*** | (2006.01) |
| ***G03G 15/08*** | (2006.01) |
| ***G03G 21/18*** | (2006.01) |

(52) U.S. Cl.

CPC ... *G03G 15/1615* (2013.01); *G03G 15/04054* (2013.01); *G03G 15/0808* (2013.01); *G03G 15/0865* (2013.01); *G03G 15/2053* (2013.01); *G03G 15/60* (2013.01); *G03G 15/757* (2013.01); *G03G 21/186* (2013.01)

(58) Field of Classification Search

CPC ..... G03G 15/757; G03G 15/1615

USPC ..... 399/167

See application file for complete search history.

(56) References Cited

U.S. PATENT DOCUMENTS 9,588,478 B1 * 3/2017 Fan ..... G03G 15/757

FOREIGN PATENT DOCUMENTS

| | | |
|---|---|---|
| JP | 2012-234073 | 11/2012 |
| JP | 2013-195961 | 9/2013 |
| JP | 2014-205560 | 10/2014 |

OTHER PUBLICATIONS

"Bearing Is Used Here", Bearing, Bearing Editorial Sub-Committee, Japan Bearing Industry Association, Aug. 2008.

(Continued)

*Primary Examiner* — William J Royer

(74) *Attorney, Agent, or Firm* — Harness, Dickey & Pierce, P.L.C.

(57) ABSTRACT

A drive transmission device, which may be included in an image forming apparatus, includes an apparatus body, a drive connecting body, a biasing body and a retracting device including an operating body and a linear body. The drive connecting body is coupled to a drive connection target body and disposed between a drive connecting position and a retracted position. The biasing body is configured to bias the drive connecting body to the drive connecting position. The operating body is configured to cause the drive connecting body to retract from the drive connecting position to the retracted position, in connection to movement of the operating body. The linear body is connected to the operating body and the drive connecting body. The operating body causes the opposed end of the linear body to move in a direction opposite a biasing direction of the biasing body.

6 Claims, 32 Drawing Sheets

(56) References Cited

OTHER PUBLICATIONS

Manabu Hoshino, et al., "Fixed Constant Velocity Joint with a Super High Operating Angle of 54 Degrees (TUJ)", NTN Technical Review No. 75 (2007) pp. 16-19.

* cited by examiner

DRIVE TRANSMISSION DEVICE AND IMAGE FORMING APPARATUS INCORPORATING THE DRIVE TRANSMISSION DEVICE

CROSS-REFERENCE TO RELATED APPLICATION

This patent application is based on and claims priority pursuant to 35 U.S.C. § 119(a) to Japanese Patent Application No. 2017-094977, filed on May 11, 2017, in the Japan Patent Office, the entire disclosure of which is hereby incorporated by reference herein.

BACKGROUND

Technical Field

This disclosure relates to a drive transmission device and an image forming apparatus incorporating the drive transmission device.

Related Art

Various types of drive transmission devices are known to include a drive connecting member, a biasing member, and a retraction mechanism. A drive coupling member is drivingly coupled to a drive coupling target member and is movable between a drive coupling position from which a driving force applied by a drive source such as a drive motor can be transmitted to the drive coupling target member and a retracted position to which the drive coupling member is retracted from the drive coupling position. The biasing member biases the drive coupling member to be located at the drive coupling position. The retraction mechanism includes an operating member operated by action of a user and causes the drive coupling member to move from the drive coupling position to the retracted position along with movement of the operating member.

A known drive transmission device includes a retraction mechanism having a retracting member that is engaged to the drive coupling member to cause the drive coupling member to move from the retracted position, against a biasing force applied by the biasing member. The retracting member is coupled to one end of a wire that functions as a linear member. The other end of the wire is coupled to a sheet feeder cover that functions as the operating member. As the sheet feeder cover opens, the retracting member is pulled by the wire and shifts. Due to the movement of the retracting member, the drive coupling member that is engaged with the retracting member is moved to the retracted position.

SUMMARY

At least one aspect of this disclosure provides a drive transmission device including an apparatus body, a drive connecting body, a biasing body, and a retracting device including an operating body and a linear body. The drive connecting body is drivably coupled to a drive connection target body and movably disposed between a drive connecting position at which the drive connecting body transmits a driving force applied by a drive source to the drive connection target body and a retracted position at which the drive connecting body is separated from the drive connection target body. The biasing body is configured to bias the drive connecting body to be located at the drive connecting position. The operating body of the retracting device is operated manually and configured to cause the drive connecting body to retract from the drive connecting position to the retracted position, in connection to movement of the operating body. One end of the linear body of the retracting device is connected to the operating body and an opposed end of the linear body is connected to the drive connecting body. The operating body causes the opposed end of the linear body to move in a direction opposite a biasing direction of the biasing body.

Further, at least one aspect of this disclosure provides an image forming apparatus including an image bearer configured to bear an image formed thereon and the above-described drive transmission device configured to transmit a driving force applied by the drive source to the image bearer.

BRIEF DESCRIPTION OF THE SEVERAL VIEWS OF THE DRAWINGS

An exemplary embodiment of this disclosure will be described in detail based on the following figures, wherein.

DETAILED DESCRIPTION

Figure 1:
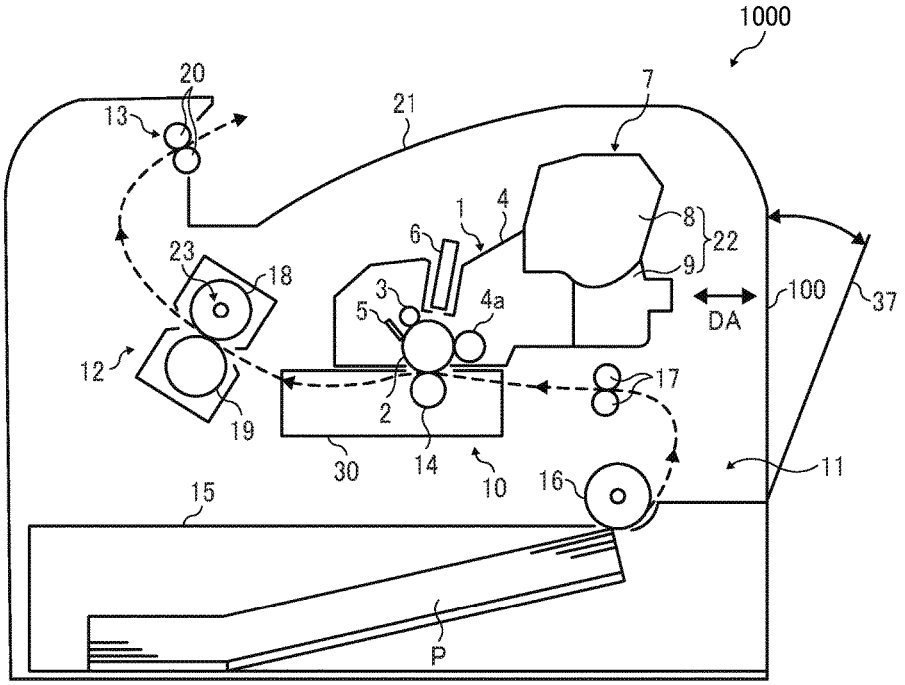
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic printer that functions as an electrophotographic image forming apparatus for forming images by electrophotography.

FIG. 1 is a schematic diagram illustrating an image forming apparatus 1000 according to an embodiment of this disclosure.

The image forming apparatus 1000 may be a copier, a facsimile machine, a printer, a multifunction peripheral or a multifunction printer (MFP) having at least one of copying, printing, scanning, facsimile, and plotter functions, or the like. According to the present example, the image forming apparatus 1000 is an electrophotographic printer that prints toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

The image forming apparatus 1000 according to the present embodiment of this disclosure, illustrated in FIG. 1, is a monochrome printer. The image forming apparatus 1000 includes an apparatus body 100 and a process cartridge 1 that is disposed detachably attached to the apparatus body 100.

The process cartridge 1 includes a photoconductor drum 2, a charging roller 3, a developing device 4, and a cleaning blade 5. The photoconductor drum 2 functions as an image bearer to bear an image on a surface thereof. The charging roller 3 functions as a charging device to uniformly charge the surface of the photoconductor drum 2. The developing device 4 includes a developing roller 4*a*. The developing device 4 develops the image formed on the surface of the photoconductor drum 2 into a visible image. The cleaning blade 5 functions as a cleaning device to clean the surface of the photoconductor drum 2.

The image forming apparatus 1000 further includes a light emitting diode (LED) head array 6 disposed near the photoconductor drum 2. The LED head array 6 functions as an exposing device to expose the surface of the photoconductor drum 2.

The process cartridge 1 includes a toner cartridge 7 that functions as a developer container. The toner cartridge 7 is detachably attached to the process cartridge 1. The toner cartridge 7 includes a container body 22 in which a developer storing section 8 and a developer collecting section 9 are provided as a single unit. The developer storing section 8 accommodates toner that functions as developer to be supplied to the developing device 4. The developer collecting section 9 collects toner (used toner or waste toner) that has been removed by the cleaning blade 5.

The image forming apparatus 1000 further includes a transfer device 10, a sheet feeding device 11, a fixing device 12, and a sheet discharging device 13. The transfer device 10 transfers the image formed on the surface of the photoconductor drum 2 onto a sheet P such as a transfer medium. The sheet feeding device 11 supplies the sheet P toward the transfer device 10. The fixing device 12 fixes the image transferred onto the sheet P to the sheet P. The sheet discharging device 13 outputs the sheet P outside the apparatus body 100 of the image forming apparatus 1000.

The transfer device 10 includes a transfer roller 14. The transfer roller 14 functions as a transfer body rotatably disposed to a transfer frame 30. The transfer roller 14 is in contact with the photoconductor drum 2 in a state in which the process cartridge 1 is attached to the apparatus body 100 of the image forming apparatus 1000. A transfer nip region is formed at a contact portion at which the photoconductor drum 2 and the transfer roller 14 contact to each other. In addition, the transfer roller 14 is connected to a power source, and a predetermined direct current (DC) voltage and/or an alternating current (AC) voltage are supplied to the transfer roller 14.

The sheet feeding device 11 includes a sheet feed tray 15 and a sheet feed roller 16. The sheet feed tray 15 accommodates the sheet P. The sheet feed roller 16 feeds the sheet P accommodated in the sheet feed tray 15. Further, a pair of registration rollers 17 is disposed downstream from the sheet feed roller 16 in a sheet conveying direction. The pair of registration rollers 17 functions as a pair of timing rollers to convey the sheet P to a transfer nip region at a proper timing of conveyance of the sheet P.

It is to be noted that the sheet P is not limited to the above-described transfer medium but also includes thick paper, post card, envelope, plain paper, thin paper, coated paper, art paper, tracing paper, and the like. The sheet P further includes a non-paper material such as OHP sheet, OHP film, and any other sheet-shaped material on which an image can be formed.

The fixing device 12 includes a fixing roller 18 and a pressure roller 19. The fixing roller 18 is heated by an infrared heater 23 that is disposed inside the fixing roller 18. The pressure roller 19 is pressed toward the fixing roller 18 to contact the fixing roller 18. A fixing nip region is formed at a position where the fixing roller 18 and the pressure roller 19 contact with each other.

The sheet discharging device 13 includes a pair of sheet ejecting rollers 20. After having been ejected to the outside of the apparatus body 100 of the image forming apparatus 1000 by the pair of sheet ejecting rollers 20, the sheet P is loaded on a sheet output tray 21 that has a concaved shape on an upper face of the apparatus body 100 of the image forming apparatus 1000.

Next, a description is given of basic functions of the image forming apparatus 1000 according to the present embodiment of this disclosure, with reference to FIG. 1. When an image forming operation is started, the photoconductor drum 2 of the process cartridge 1 is rotated in a clockwise direction in FIG. 1, and the charging roller 3 uniformly charges the surface of the photoconductor drum 2 with a predetermined polarity. The LED head array 6 emits a light beam onto the charged face of the photoconductor drum 2 based on image data input from an external device, so that an electrostatic latent image is formed on the surface of the photoconductor drum 2.

Accordingly, the developing device 4 supplies toner onto the electrostatic latent image formed on the photoconductor drum 2, thereby developing (visualizing) the electrostatic latent image into a visible image as a toner image.

Further, as the image forming operation is started, the transfer roller 14 is rotated and a predetermined direct current (DC) and/or the alternating current (AC) are supplied to the transfer roller 14. As a result, a transfer electric field is formed between the transfer roller 14 and the opposing photoconductor drum 2.

By contrast, the sheet feed roller 16 that is disposed in a lower portion of the apparatus body 100 of the image forming apparatus 1000 is driven and rotated to feed the sheet P from the sheet feed tray 15. Conveyance of the sheet P fed from the sheet feed tray 15 is interrupted by the pair of registration rollers 17 temporarily.

Thereafter, at the predetermined timing, the pair of registration rollers 17 starts rotating again. Then, in synchronization with movement of the toner image formed on the surface of the photoconductor drum 2 reaching the transfer nip region, the sheet P is conveyed to the transfer nip region. Consequently, by forming the transfer electric field, the toner image formed on the surface of the photoconductor drum 2 is collectively transferred onto the sheet P. After the transfer of the toner image from the photoconductor drum 2 onto the sheet P, the cleaning blade 5 removes residual toner, which is failed to be transferred onto the sheet P and therefore remains on the surface of the photoconductor drum 2, from the surface of the photoconductor drum 2. The removed toner is conveyed and collected into the developer collecting section 9 of the container body 22.

Thereafter, the sheet P having the toner image thereon is conveyed to the fixing device 12, where the toner image is fixed to the sheet P. Then, the sheet P is ejected by the pair of sheet ejecting rollers 20 to the outside of the apparatus body 100 of the image forming apparatus 1000 and stacked onto the sheet output tray 21.

The image forming apparatus 1000 further includes a cover 37 on a side face (the right side face in FIG. 1) of the apparatus body 100. The cover 37 opens and closes in a direction indicated by arrow DA in FIG. 1. By opening the cover 37, the process cartridge 1 can be removed from the apparatus body 100 of the image forming apparatus 1000.

Figure 2:
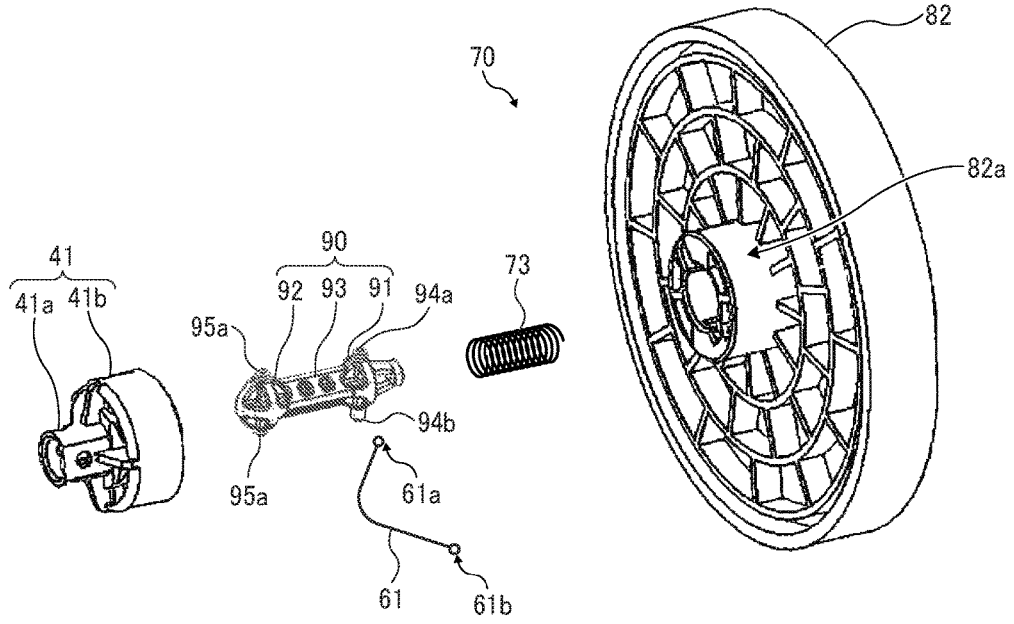
FIG. 2 is an exploded perspective view illustrating a drive transmission device according to an embodiment of this disclosure.
Figure 3:
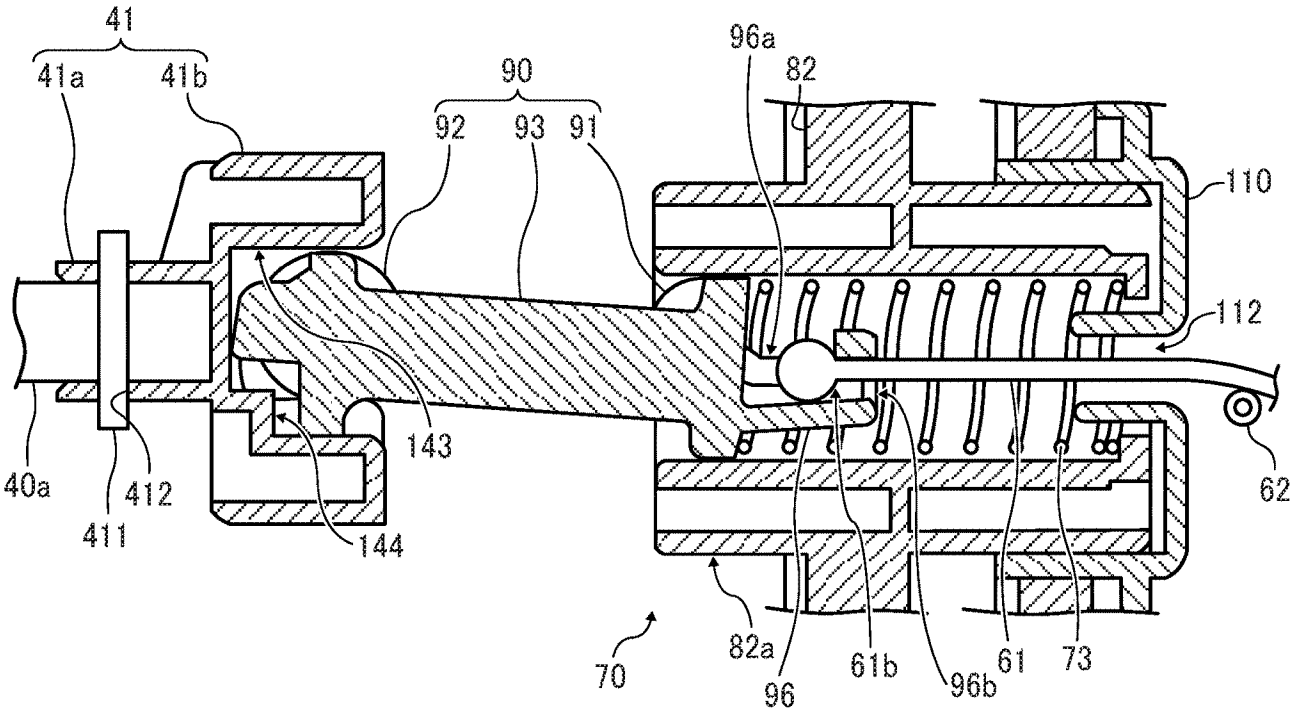
FIG. 3 is a cross sectional view illustrating the drive transmission device of FIG. 2.

FIG. 2 is an exploded perspective view illustrating a drive transmission device 70 according to an embodiment of this disclosure. FIG. 3 is a cross sectional view illustrating the drive transmission device 70 of FIG. 2.

The drive transmission device 70 includes a photoconductor gear 82, a coupling member 41, a drive connecting member 90, and a spring 73. The photoconductor gear 82 receives a driving force applied by a drive motor that functions as a drive source. The coupling member 41 functions as a drive connection target body and is attached at one end of a photoconductor drum shaft 40*a* of the photoconductor gear 82. The drive connecting member 90 functions as a drive connecting body and drivably coupled to the coupling member 41. The spring 73 functions as a biasing body to bias the drive transmission device 70 attached to the photoconductor gear 82 toward the coupling member 41.

A drive side cylindrical portion 82*a* into which a drive side spherical portion 91 of the drive connecting member 90 is inserted is included in a rotation center of the photoconductor gear 82. The drive side spherical portion 91 functions as a first inserting body of the drive connecting member 90. The drive side cylindrical portion 82*a* of the photoconductor gear 82 is rotatably supported by a bearing 110 that has been fit and secured to an opening portion of a far side bearing 110. Accordingly, the photoconductor gear 82 is rotatably supported by a far side panel 100*b* (FIG. 22) via the bearing 110.

A regulating portion 112 is formed at the center of the bearing 110. The regulating portion 112 has a cylindrical shape extending toward the drive connecting member 90. The regulating portion 112 is inserted from a far side of the drive side cylindrical portion 82*a* into the spring 73 that is held in the drive side cylindrical portion 82*a*. Consequently, a spring bearing 96 of the drive connecting member 90 abuts contacts or abuts against the regulating portion 112, and therefore movement of the drive connecting member 90 toward the far side of the drive side cylindrical portion 82*a*.

Further, in the present embodiment, the regulating portion 112 has a cylindrical shape so that a wire 61 that functions as a linear member passes through the regulating portion 112 to come out to the far side of the drive transmission device 70. Then, the wire 61 is installed to the far side of the image forming apparatus 1000 and a first connecting portion 61*a* is connected to the cover 37.

The coupling member 41 includes a cylindrical shaft inserting portion 41*a* into which a leading end portion of the photoconductor drum shaft 40*a* is inserted, and a driven side cylindrical portion 41*b* to which a driven side spherical portion 92, which functions as a second inserting body, of the drive connecting member 90 is inserted. A through hole 412 through which a parallel pin 411 penetrates is provided in the shaft inserting portion 41*a*. The parallel pin 411 is provided to the photoconductor drum shaft 40*a*.

The drive connecting member 90 includes the drive side spherical portion 91 that functions as a first inserting body, the driven side spherical portion 92 that functions as a second inserting body, and a connecting portion 93 that functions as a connecting body to link and connect the drive side spherical portion 91 and the driven side spherical portion 92. The drive side spherical portion 91 includes a first drive side projection 94*a* and a second drive side projection 94*b*. The first drive side projection 94*a* protrudes from a surface of the drive side spherical portion 91 in a radial direction. The second drive side projection 94*b* is provided at an interval of an angle of 180 degrees in a rotation direction from the first drive side projection 94*a*. The driven side spherical portion 92 includes two driven side projections 95*a*, each of which protrudes from a surface of the driven side spherical portion 92 in the radial direction at an interval of an angle of 180 degrees in the rotation direction.

Figure 22:
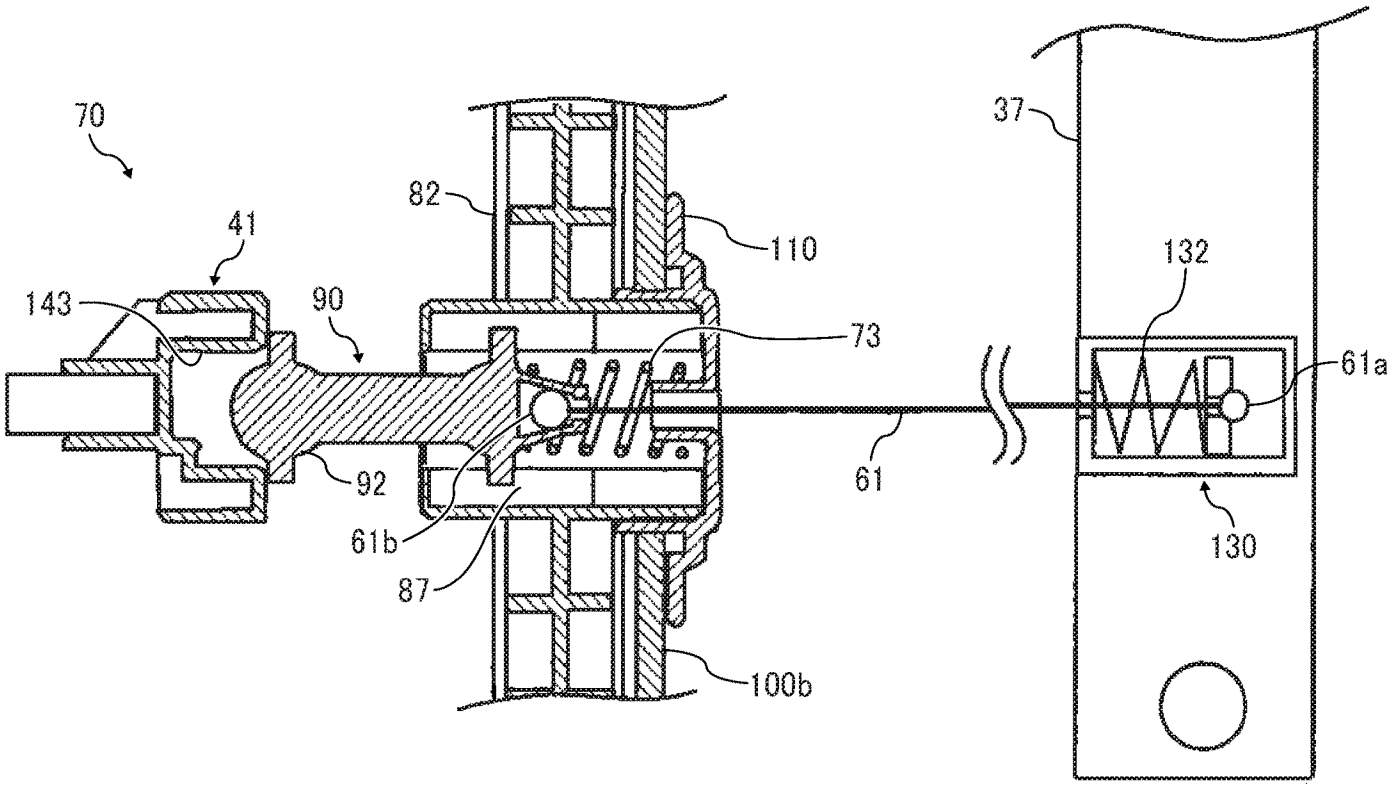
FIG. 22 is a diagram illustrating a state in which the cover is closed when the phase of the coupling member attached to a drum shaft and the phase of a drive connecting member do not match.

Further, the spring bearing 96 is provided in a rotation center of the drive side spherical portion 91. The spring bearing 96 receives the opposed end of the spring 73 provided in the above-described drive side opening 87 (FIG. 22). The spring bearing 96 includes an attaching portion 96*a* and a through hole 96*b*. A second connecting portion 61*b* is attached to the attaching portion 96*a*. The second connecting portion 61*b* has a spherical shape and is mounted on the opposed end of the wire 61 that functions as a linear member. The wire 61 passes through the through hole 96*b*. The diameter of the through hole 96*b* is greater than the first connecting portion 61*a* that has a spherical shape and is connected to the cover 37 that functions as an operating member. Further, the diameter of the through hole 96*b* is smaller than the diameter of the second connecting portion 61*b*.

Since the diameter of the through hole 96*b* is greater than the diameter of the first connecting portion 61*a*, the first connecting portion 61*a* can pass from the attaching portion 96*a* through the through hole 96*b*. Further, since the diameter of the through hole 96*b* is smaller than the diameter of the second connecting portion 61*b*, the second connecting portion 61*b* does not come out from the through hole 96*b*. Accordingly, the second connecting portion 61*b* is attached to the attaching portion 96*a*.

Figure 5:
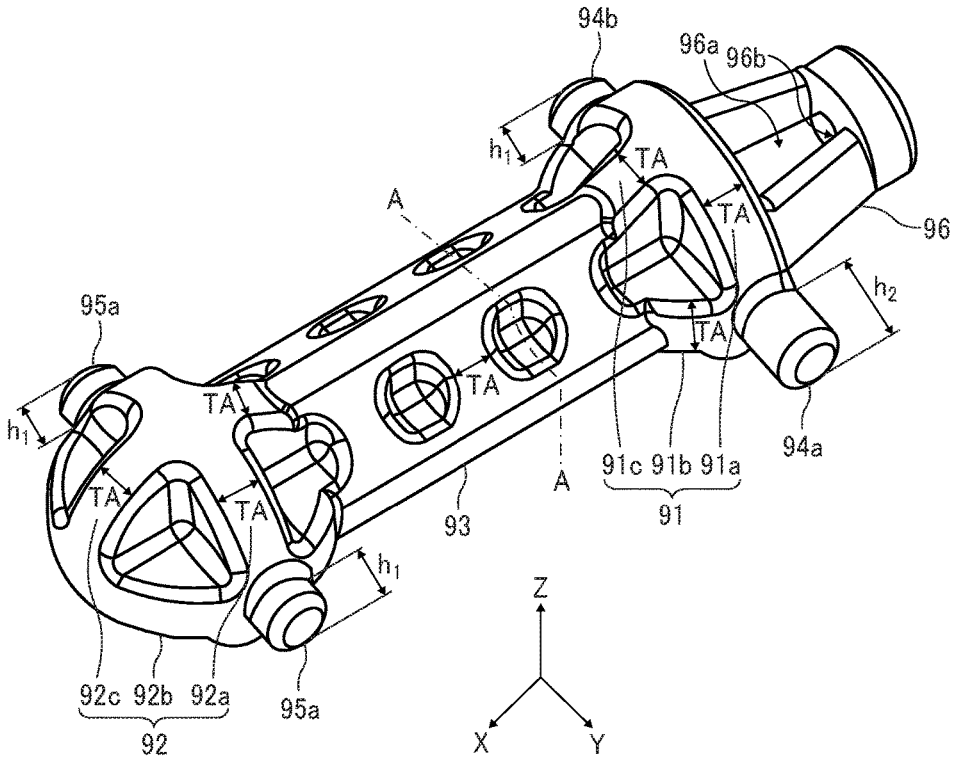
FIG. 5 is a schematic diagram illustrating a drive connecting member.
Figure 6:
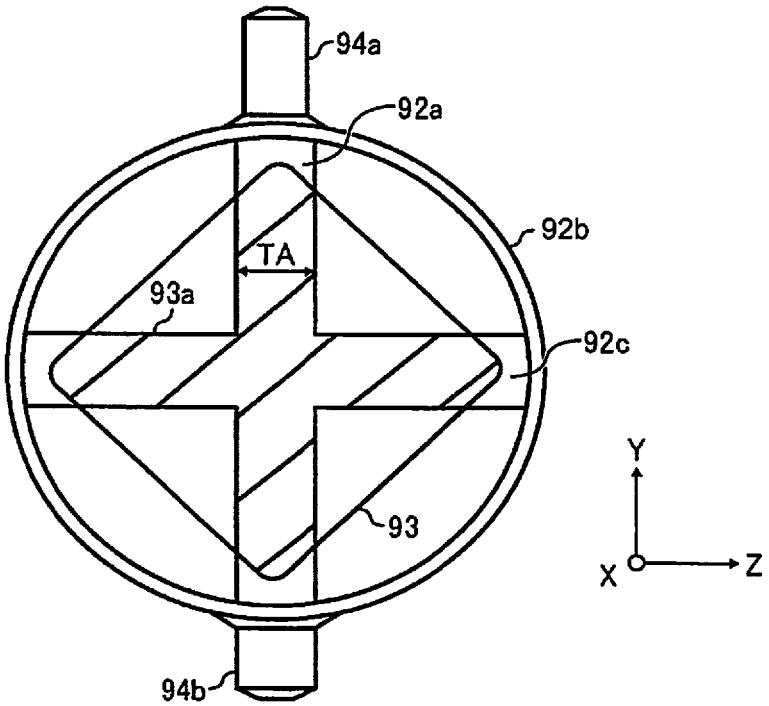
FIG. 6 is a cross sectional view illustrating the drive transmission device, along a line A-A of FIG. 5.

FIG. 5 is a schematic diagram illustrating the drive connecting member 90. FIG. 6 is a cross sectional view illustrating the drive connecting member 90, along a line A-A of FIG. 5.

In the description below, an axial direction is an X direction, a protruding direction of the driven side projections 95*a* is a Y direction, and a direction perpendicular to the X direction and the Y direction is a Z direction. Further, in the description below, the axial direction is the X direction, a protruding direction of each of the first drive side projection 94*a*, the second drive side projection 94*b* and the driven side projections 95*a* is the Y direction, and the direction perpendicular to the X direction and the Y direction is the Z direction.

The drive connecting member 90 is a resin molded item, and the drive side spherical portion 91, the driven side spherical portion 92, the connecting portion 93, the first drive side projection 94*a*, the second drive side projection 94*b*, and the driven side projections 95*a* are an integrated object made of resin material. As the resin used for formation of the drive connecting member 90, a polyacetal resin (POM) having excellent mechanical strength and favorable wear resistance and slidability may be preferably used. Further, the drive connecting member 90 may be aluminum casting manufactured by aluminum diecast.

The first drive side projection 94*a* and the second drive side projection 94*b* have a columnar shape, and are provided in intersecting portions of a first drive side large circle 91*a* and a second drive side large circle 91*b*. A height h2 of the second drive side projection 94*b* is greater than a height h1 of the driven side projections 95*a* and the first drive side projection 94*a*. In the present embodiment, the drive side spherical portion 91 has a lightened hemisphere shape. However, the shape may be appropriately determined according to a maximum inclination angle of the drive connecting member 90.

The driven side projections 95*a* also have a columnar shape, and are provided in intersecting places of a first driven side large circle 92*a* and a second driven side large circle 92*b*. A third driven side large circle 92*c* of the driven side spherical portion 92 on the coupling member side with respect to the first driven side large circle 92*a* is formed in one direction side (see FIGS. 3 and 4) of the Z direction with respect to the second driven side large circle 92*b*, and has a shape cut in the opposed side of the Z direction.

The spring bearing 96 is provided to the rotation center of the drive side spherical portion 91. The spring bearing 96 includes the attaching portion 96*a* and the through hole 96*b*. The second connecting portion 61*b* has a spherical shape and is mounted on the opposed end of the wire 61. The wire 61 passes through the through hole 96*b*.

Since the drive connecting member 90 is molded by injection molding or the like, sink marks are caused, and therefore the drive side spherical portion 91, the driven side spherical portion 92 and the connecting portion 93 are deformed due to the sink marks. As a result, it is likely that the deformation affects the quality. Therefore, in the present embodiment, the drive side spherical portion 91, the driven side spherical portion 92 and the connecting portion 93 are lightened, and occurrence of the sink marks is restrained.

The drive side spherical portion 91 has a hemisphere shape that is lightened, leaving the first drive side large circle 91*a* that is a spherical large circle perpendicular to the X direction, the second drive side large circle 91*b* that is a spherical large circle perpendicular to the Z direction, and a third drive side large circle 91*c* that is a spherical large circle perpendicular to the Y direction.

The driven side spherical portion 92 has a hemisphere shape that is lightened, leaving the first driven side large circle 92*a* that is a spherical large circle perpendicular to the X direction, the second driven side large circle 92*b* that is a spherical large circle perpendicular to the Z direction, and the third driven side large circle 92*c* that is a spherical large circle perpendicular to the Y direction.

It is to be noted that the large circle refers to a circle made such that a plane, which passes through the center of a sphere, intersects with a spherical surface.

Further, the connecting portion 93 has an approximately square pole shape, and multiple lightening portions 93*a* formed by lightening side surfaces of the connecting portion 93 is provided at intervals TA in the X direction in FIG. 6.

As illustrated in FIG. 6, the multiple lightening portions 93*a* are lightened, leaving a linear portion extending in the Y direction and a linear portion extending in the Z direction in FIG. 6 and have a cross shape in cross section. Further, the connecting portion 93 is formed to have the side surfaces inclined by an angle of 45 degrees with respect to the Y direction. As described above, by forming the side surfaces to be inclined by an angle of 45 degrees with respect to the Y direction, the linear portions of the multiple lightening portions 93*a* become diagonal lines of a square. As a result, the linear portions of the multiple lightening portions 93*a* can be made longer than a case in which the side surfaces of the connecting portion 93 are formed to become planes parallel to a plane perpendicular to the Y direction. Accordingly, a decrease in strength of the connecting portion 93 due to the lightening can be restrained.

Figure 7A:
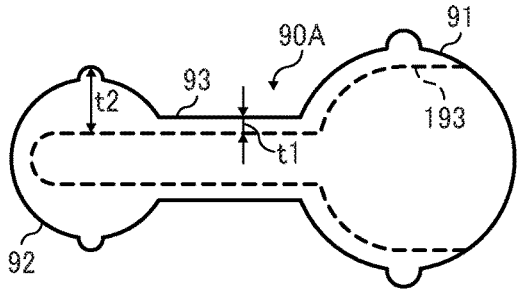
FIGS. 7A, 7B and 7C are diagrams illustrating an example of lightening of a comparative drive connecting member.
Figure 7B:
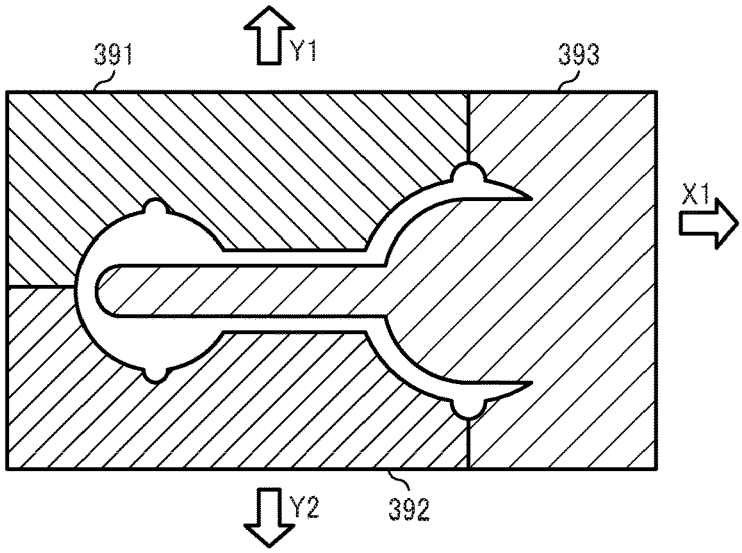
Figure 7C:
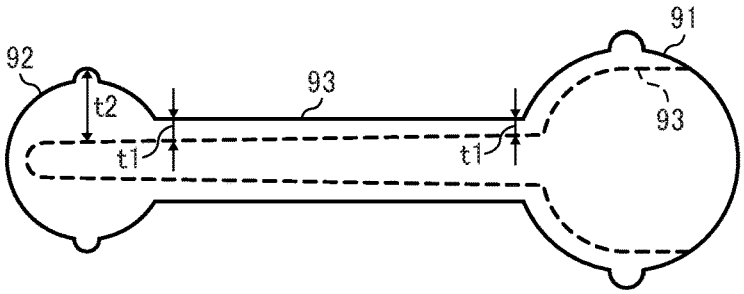

FIGS. 7A, 7B and 7C are diagrams illustrating an example of lightening of a comparative drive connecting member 90A.

Figure 8A:
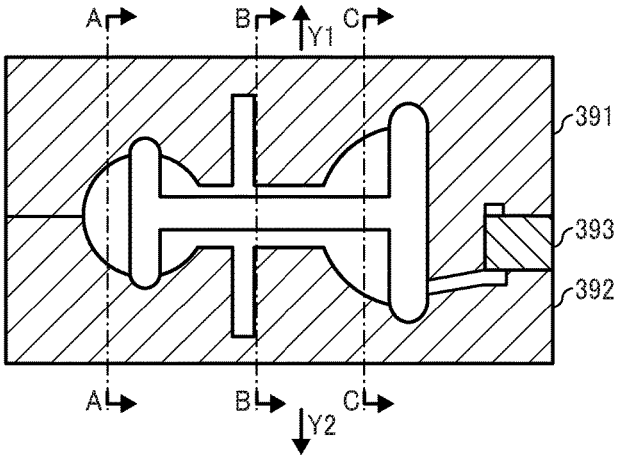
FIGS. 8A, 8B, 8C and 8D are diagrams illustrating a molding example of the drive connecting member according to the present embodiment of this disclosure.

As illustrated in FIG. 7A, in a case of restraining the thickness of the drive connecting member 90A to restrain sink marks by providing a lightening portion 193 having a hole shape with a drive side spherical portion 91 side open to the drive connecting member 90A, a mold structure becomes the one illustrated in FIG. 7B. That is, as shown in FIG. 8A, the mold structure includes a first mold 391 that is moved in a Y1 direction, a second mold 392 that is moved in a Y2 direction, and a third mold 393 that is moved in an X1 direction. In such lightening, the third mold 393, which forms the lightening portion 193 having a slot extending in the shaft direction, is to be moved in the X1 direction significantly to pull out the third mold 393 from the molded drive connecting member 90A. Further, the portion of the third mold 393, where the lightening portion 193 having a hole shape is formed, is at least (pi) 8 mm due to strength and the like, and therefore it is difficult to achieve a reduction in size of the drive connecting member 90A.

Further, the comparative structure provided with the lightening portion 193 having a hole shape has a thickness t1 of the connecting portion 93 and a thickness t2 of different portions of the driven side spherical portion 92. In the comparative structure, the lightening portion 193 has a shape with a diameter gradually increasing toward the drive side in order to favorably pull out the third mold 393 from the molded drive connecting member 90A. As a result, in a case where the drive connecting member 90A has the shape extending in the shaft direction, as illustrated in FIG. 7C, the driven side spherical portion 92 is not sufficiently lightened and the thickness t2 of the driven side spherical portion 92 becomes thick, and the sink marks of the driven side spherical portion 92 cannot be sufficiently restrained. Therefore, in the structure illustrated in FIGS. 7A, 7B and 7C, the shaft direction length of the drive connecting member 90A is reduced to 25 mm or less to reduce the thickness t2 of the driven side spherical portion 92.

FIGS. 8A, 8B, 8C and 8D are diagrams illustrating a molding example of the drive connecting member 90 according to the present embodiment of this disclosure.

Figure 8B:
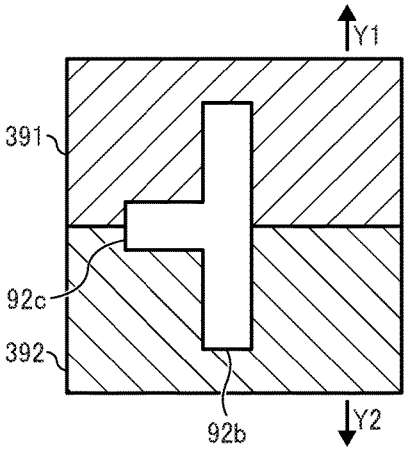
Figure 8C:
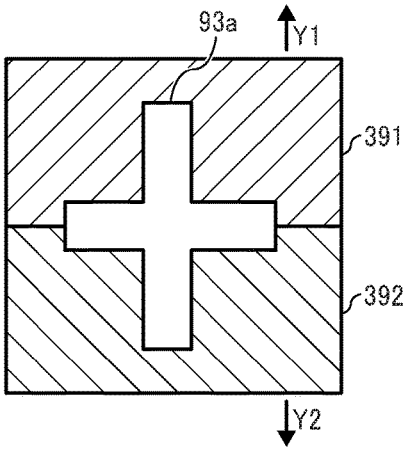
Figure 8D:
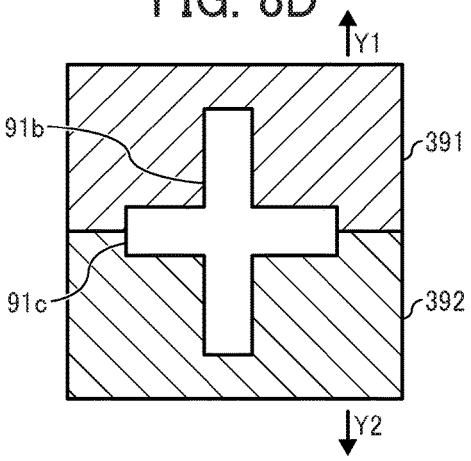

FIG. 8A is a lateral cross sectional view illustrating the molding example of the drive connecting member 90. FIG. 8B is a vertical cross sectional view illustrating the drive connecting member 90, along a line A-A of FIG. 8A. FIG. 8C is a vertical cross sectional view illustrating the drive connecting member 90, along a line B-B of FIG. 8A. Further, FIG. 8D is a vertical cross sectional view illustrating the drive connecting member 90, along a line C-C of FIG. 8A.

By forming the lightening portion 93*a* into the cross shape in cross section made of the linear portion extending in the Y direction and the linear portion extending in the Z direction, the connecting portion 93 is formed by a first mold 391 and a second mold 392, as illustrated in FIG. 8C. Further, in the present embodiment, as illustrated in FIGS. 8B and 8D, the drive side spherical portion 91 and the driven side spherical portion 92 are lightened to include the second drive side large circle 91*b* and the third drive side large circle 91*c* of the drive side spherical portion 91 and the second driven side large circle 92*b* and the third driven side large circle 92*c* of the driven side spherical portion 92, molded with the first mold 391 and the second mold 392. Accordingly, the drive side spherical portion 91 and the driven side spherical portion 92 can be molded with the first mold 391 and the second mold 392. Accordingly, as illustrated in FIG. 8A, the connecting portion 93 of drive connecting member 90, the drive side spherical portion 91 and the driven side spherical portion 92 are molded with the first mold 391 that is moved in the Y1 direction and the second mold 392 that is moved in the Y2 direction. Further, the drive connecting member 90 can be reduced in size, compared with the configuration illustrated in FIGS. 7A through 7C. Further, even when the length of the drive connecting member 90 in the axial direction is increased, the thicknesses of the driven side spherical portion 92, the connecting portion 93 and the drive side spherical portion 91 can be made equal. Accordingly, even when the drive connecting member 90 has a slot shape extending in the axial direction, a decrease in accuracy due to an influence of the sink marks can be restrained.

Figure 4:
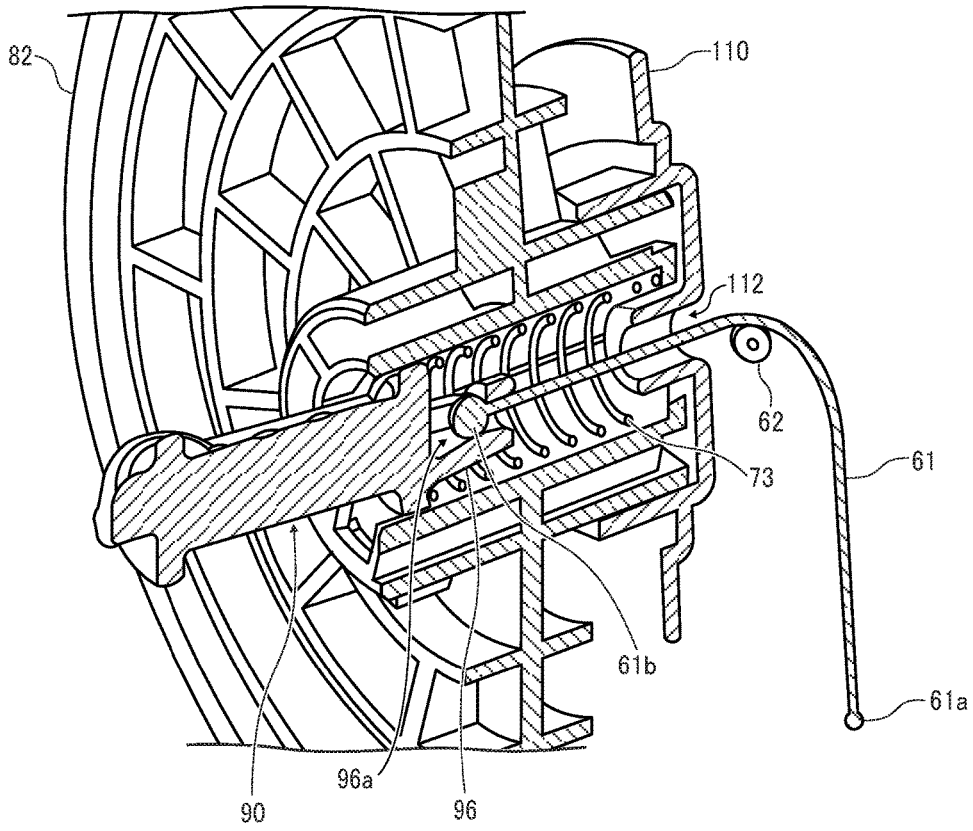
FIG. 4 is a cross sectional perspective view illustrating the drive transmission device of FIG. 2 without a coupling member.

In the present embodiment, the thickness of the first drive side large circle 91*a*, the second drive side large circle 91*b*, and the third drive side large circle 91*c* of the drive side spherical portion 91, the first driven side large circle 92*a*, the second driven side large circle 92*b*, and the third driven side large circle 92*c* of the driven side spherical portion 92, and the thickness of the lightening portion 93*a* of the connecting portion 93, as illustrated in FIG. 4, and the thickness of the lightening portion 93*a* of the connecting portion 93 are equally TA [mm], as illustrated in FIG. 5. Accordingly, the influence due to the sink marks of these portions can be restrained, and the drive connecting member 90 can be accurately molded.

Figure 9:
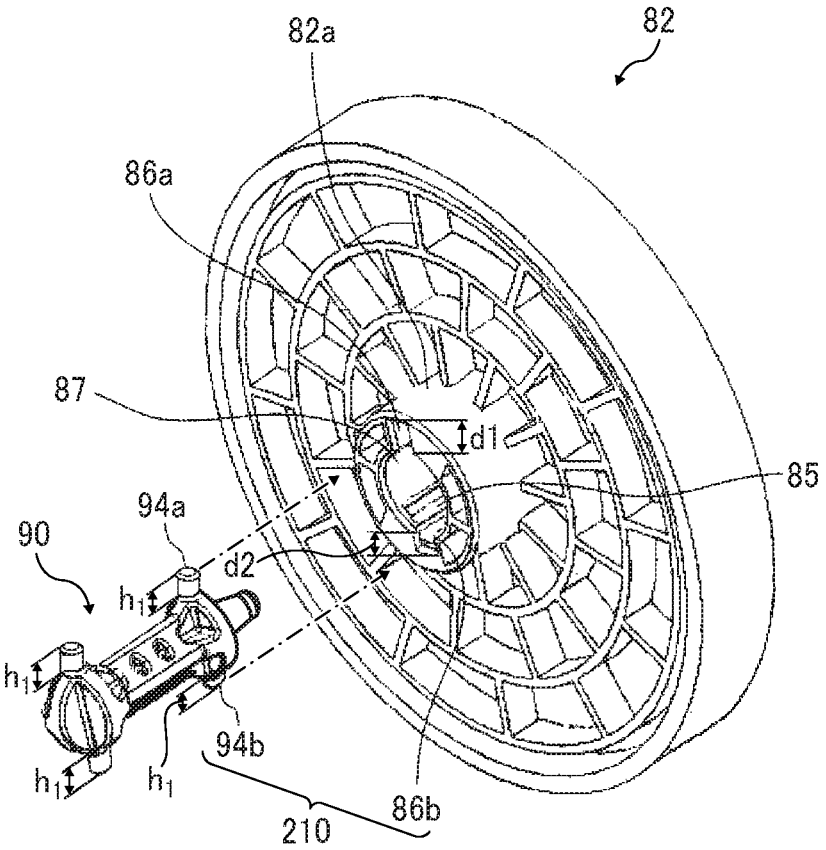
FIG. 9 is a perspective view illustrating a photoconductor gear and the drive connecting member.
Figure 10:
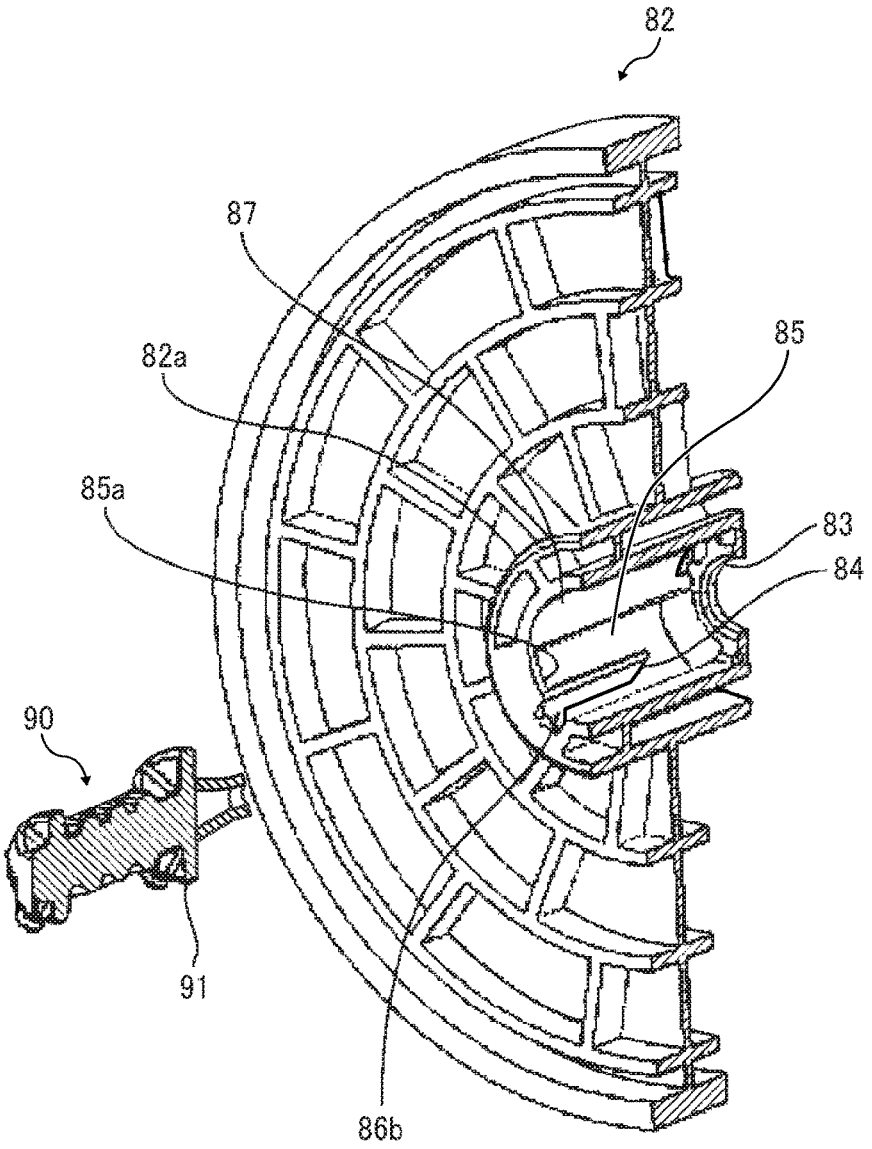
FIG. 10 is a cross sectional perspective view illustrating the photoconductor gear and the drive connecting member.

FIG. 9 is a perspective view illustrating the photoconductor gear 82 and the drive connecting member 90. FIG. 10 is a cross sectional perspective view illustrating the photoconductor gear 82 and the drive connecting member 90.

The photoconductor gear 82 is a resin molded item made of a polyacetal resin (POM), and includes the drive side cylindrical portion 82*a* in the rotation center. The drive side cylindrical portion 82*a* is provided with a drive side opening 87 into which the drive side spherical portion 91 of the drive connecting member 90 is inserted. Further, the drive side cylindrical portion 82*a* also includes two drive side grooves 85 into which the first drive side projection 94*a* and the second drive side projection 94*b* of the drive connecting member 90 are inserted, with an interval of an angle of 180 degrees in the rotation direction.

Further, the drive side cylindrical portion 82*a* includes guide grooves 86 including a first guide groove 86*a* and a second guide groove 86*b*. The first guide groove 86*a* is disposed adjacent to one of the two drive side grooves 85 in the rotation direction to guide the first drive side projection 94*a*. The second guide groove 86*b* that functions as a phase matching groove is disposed adjacent to the other of the two drive side grooves 85 in the rotation direction to guide the second drive side projection 94*b*. The one of the two drive side grooves 85 and the first guide groove 86*a* communicate with each other at a far side via a communication portion 84. The other of the two drive side grooves 85 and the second guide groove 86*b* similarly communicate with each other at a far side via the communication portion 84.

A groove depth d1 of the first guide groove 86*a* is made slightly greater than the height h1 of the first drive side projection 94*a*. By contrast, a groove depth d2 of the second guide groove 86*b* is greater than the height h2 of the second drive side projection 94*b* and is smaller than the height h1 of the first drive side projection 94*a* and the driven side projections 95*a* ($h2<d2<h1$).

The height h1 of the first drive side projection 94*a* is greater than the height h2 of the second drive side projection 94*b* that functions as a phase matching projection, and the groove depth d2 of the second guide groove 86*b* that functions as a phase matching groove is smaller than the depth d1 of the first guide groove 86*a*. Further, the depth d2 of the second guide groove 86*b* is smaller than the height h1 of the first drive side projection 94*a*. With the configuration, the second drive side projection 94*b* having the height h2 alone can be inserted into the second guide groove 86*b*, and the drive connecting member 90 can be attached to the photoconductor gear 82 at a predetermined phase to the photoconductor gear 82. That is, in the present embodiment, the second drive side projection 94*b* and the second guide groove 86*b* configure a first phase matching device 210.

Further, the diameter of the second drive side projection 94*b* as a phase matching projection may be made greater than the diameter of the first drive side projection 94*a*, and the groove width of the first guide groove 86*a* may be made smaller than the diameter of the second drive side projection 94*b*. With this configuration, the second drive side projection 94*b* can be inserted into the second guide groove 86*b* alone, and the drive connecting member 90 can be attached to the photoconductor gear 82 at a predetermined phase to the photoconductor gear 82.

Further, the diameter of the second drive side projection 94*b* as a phase matching projection may be made smaller than the diameter of the first drive side projection 94*a*, and the groove width of the second guide groove 86*b* may be made smaller or shorter than the diameter of the first drive side projection 94*a*. With this configuration, the second drive side projection 94*b* can be inserted into the second guide groove 86*b* alone, and the drive connecting member 90 can be attached to the photoconductor gear 82 at a predetermined phase to the photoconductor gear 82.

Further, the second drive side projection 94*b* may have a recess in a position that does not affect drive transmission of the second drive side projection 94*b* and the second guide groove 86*b* may have a projection to be engaged to the recess of the second drive side projection 94*b*. By so doing, the projection of the second guide groove 86*b* may prevent the first drive side projection 94*a* from inserting into the second guide groove 86*b*. With this configuration, the second drive side projection 94*b* can be inserted into the second guide groove 86*b* alone, and the drive connecting member 90 can be attached to the photoconductor gear 82 at a predetermined phase to the photoconductor gear 82.

Further, the second drive side projection 94*b* may have a projection in a position that does not affect drive transmission of the second drive side projection 94*b* and the second guide groove 86*b* may have a recess to be engaged to the projection of the second drive side projection 94*b*.

Figure 11:
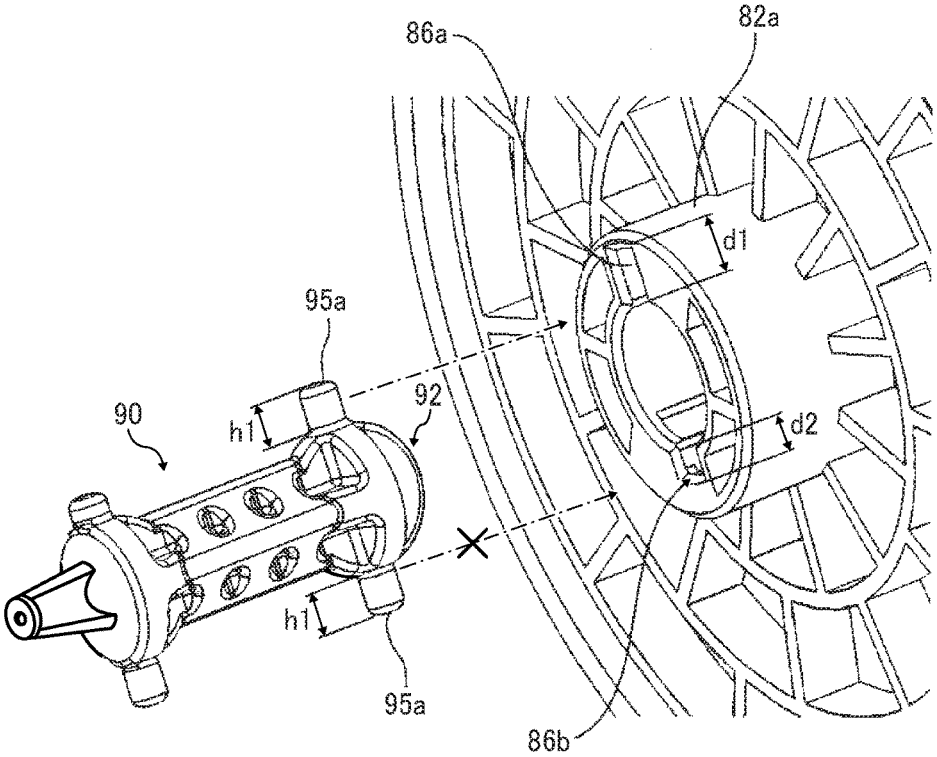
FIG. 11 is a diagram illustrating a case in which a driven side spherical portion of the drive connecting member is to be inserted into a drive side cylindrical portion.

FIG. 11 is a diagram illustrating a case in which the driven side spherical portion 92 of the drive connecting member 90 is to be inserted into the drive side cylindrical portion 82*a*.

As illustrated in FIG. 11, the height h1 of the driven side projections 95*a* is greater than the depth d2 of the second guide groove 86*b*. Accordingly, even when the driven side spherical portion 92 of the drive connecting member 90 is attempted to insert into the drive side cylindrical portion 82*a*, the driven side projections 95*a* cannot be inserted into the second guide groove 86*b*. Accordingly, the configuration of the present embodiment can prevent the driven side spherical portion 92 from being attached to the drive side cylindrical portion 82*a*.

In the present embodiment, the height of the driven side projections 95*a* is made greater than the depth d2 of the second guide groove 86*b*, so as to prevent improper mounting. However, the configuration is not limited thereto and a configuration in which the driven side projections 95*a* cannot be inserted into the first guide groove 86*a* or the second guide groove 86*b*. For example, improper mounting of the drive connecting member 90 can be prevented by making the height of the driven side projections 95*a* greater than the depth of the first guide groove 86*a*.

Alternatively, by making the diameter of the driven side projections 95*a* greater than the width of the guide groove (i.e., at least one of the first guide groove 86*a* and the second guide groove 86*b*), the driven side projections 95*a* cannot be inserted into the guide groove (i.e., at least one of the first guide groove 86*a* and the second guide groove 86*b*), and therefore the improper mounting can be prevented.

Further, by providing a projection on a side face of the driven side projections 95*a*, when the driven side projections 95*a* is inserted into the guide groove (i.e., at least one of the first guide groove 86*a* and the second guide groove 86*b*), the projection is caught to prevent the improper mounting.

Further, the diameter of the driven side spherical portion 92 may be made greater than the inner diameter of the drive side opening 87, so that the driven side spherical portion 92 that functions as a second inserting body cannot be inserted into the drive side opening 87 of the drive side cylindrical portion 82*a*. By so doing, the improper mounting can be prevented.

Further, as illustrated in FIG. 10, a retaining portion 85*a* is provided at the coupling member side end portion (the near side end portion) of the drive side grooves 85. According to this configuration, in a case in which the drive connecting member 90 is about to come out from the coupling member side end portion of the drive side opening 87, the first drive side projection 94*a* and the second drive side projection 94*b* contact the retaining portion 85*a*. Accordingly, the drive connecting member 90 is prevented from coming out from the coupling member side end portion of the drive side opening 87. A drive side inserting opening portion 83 is provided at the far side end of the drive side cylindrical portion 82*a*, so that the regulating portion 112 of the regulating portion 112 of the bearing 110 is inserted into the drive side inserting opening portion 83, as illustrated in FIG. 3.

Figure 12:
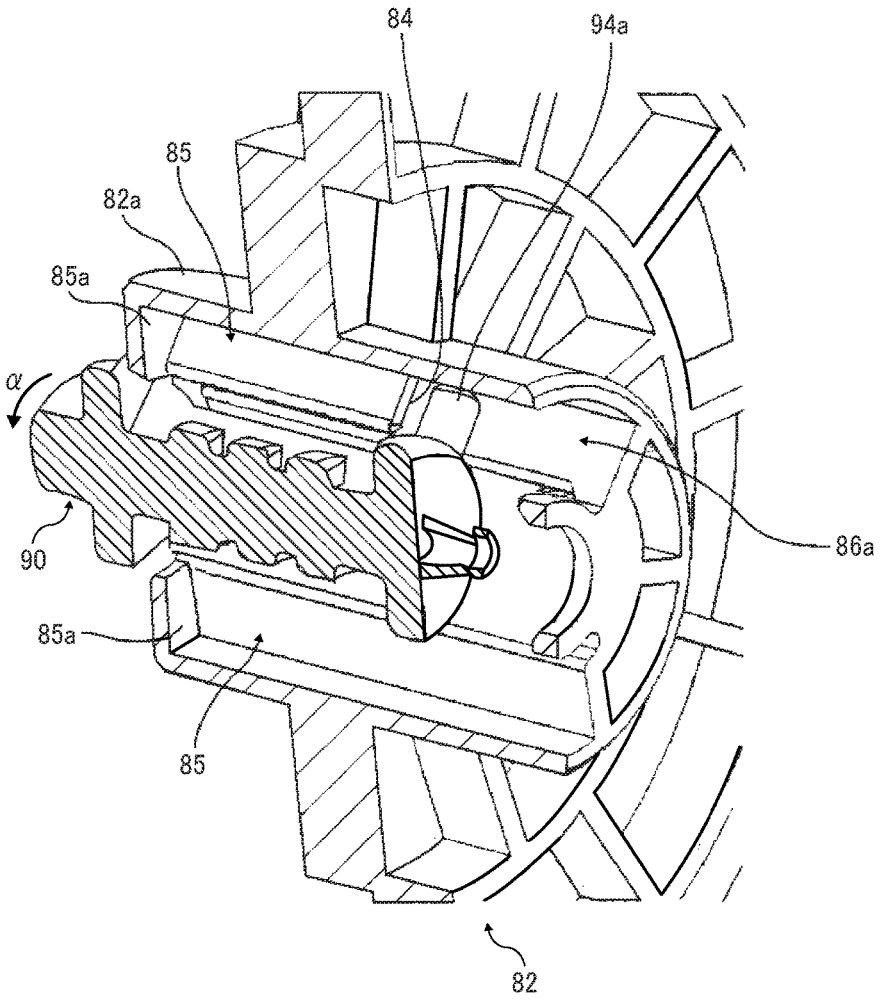
FIG. 12 is a cross sectional perspective view illustrating a state in which the drive connecting member is inserted up to a position where a first drive side projection and a second drive side projection come to a communication portion.
Figure 13:
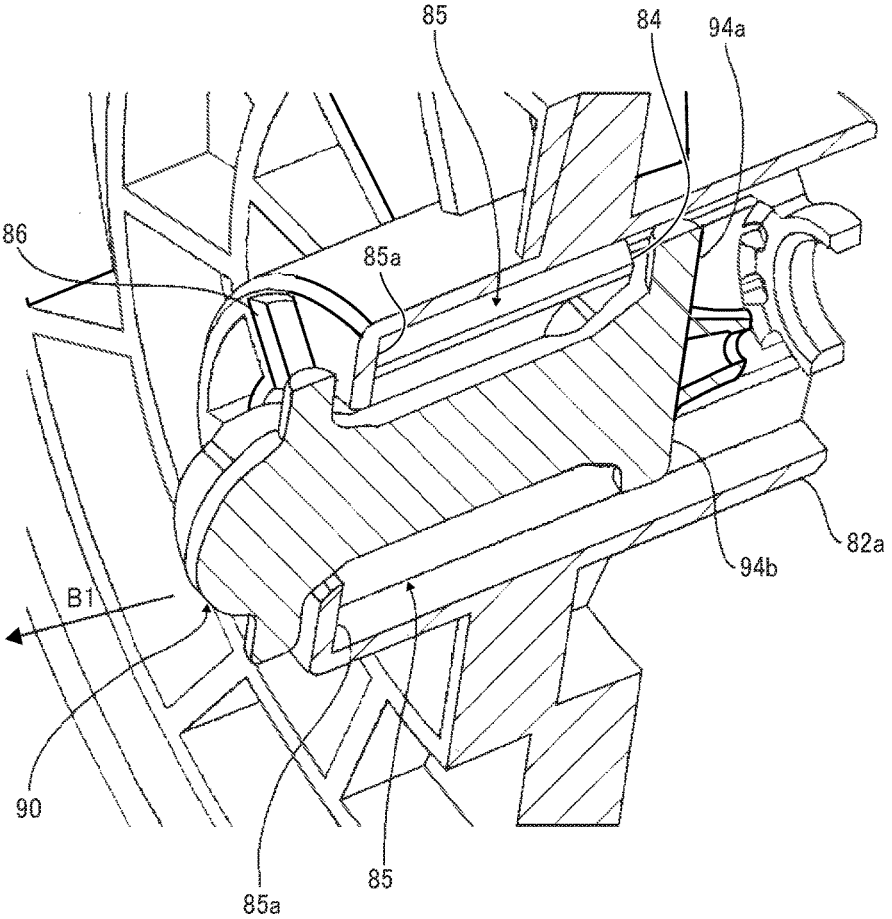
FIG. 13 is a cross sectional perspective view illustrating a state in which the drive connecting member is rotated and each drive side projection is moved to a drive side groove via the communication portion.
Figure 14:
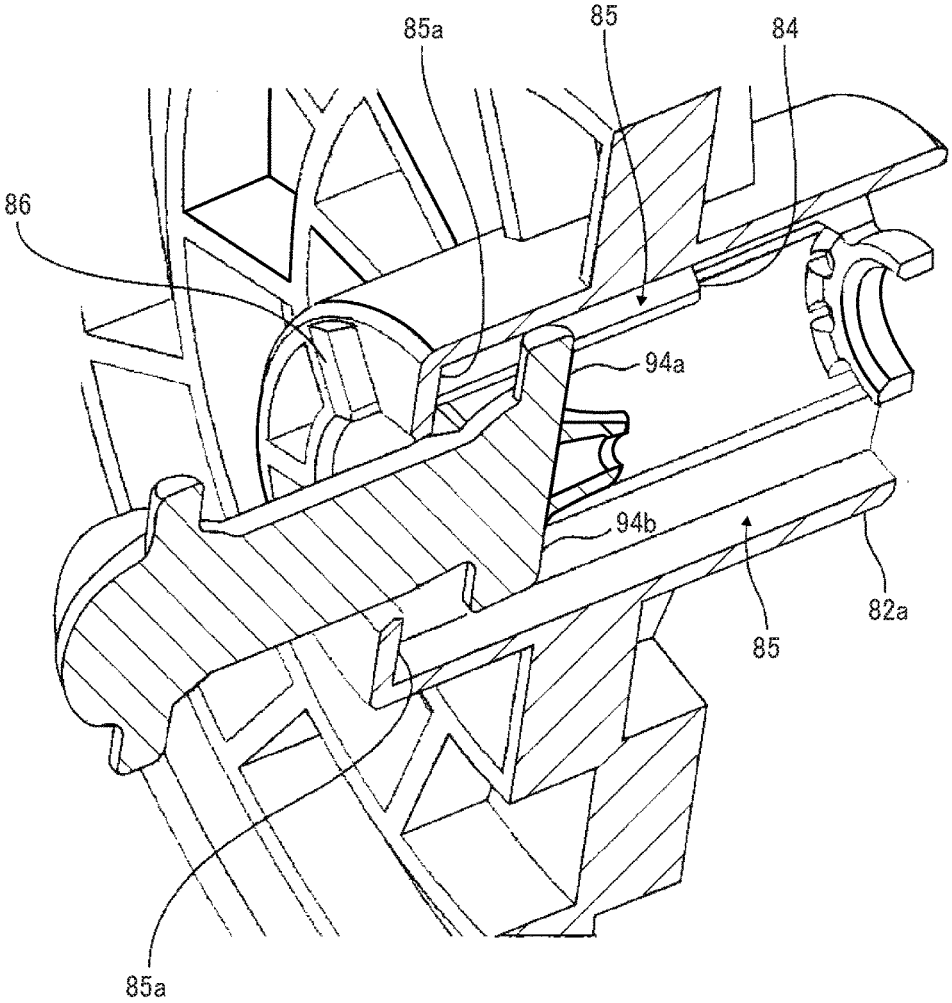
FIG. 14 is a cross sectional perspective view illustrating a state in which each drive side projection is inserted into the corresponding drive side groove.

Next, a description is given of attachment of the drive connecting member 90 to the photoconductor gear 82, with reference to FIGS. 12, 13 and 14.

FIG. 12 is a cross sectional perspective view illustrating a state in which the drive connecting member 90 is inserted up to a position where the first drive side projection 94*a* and the second drive side projection 94*b* come to the communication portion 84. FIG. 13 is a cross sectional perspective view illustrating a state in which the drive connecting member 90 is rotated and the first drive side projection 94*a* and the second drive side projection 94*b* is moved to the corresponding drive side grooves 85 via the communication portion 84. FIG. 14 is a cross sectional perspective view illustrating a state in which the first drive side projection 94*a* and the second drive side projection 94*b* is inserted into the corresponding drive side grooves 85.

First, before the drive connecting member 90 is attached to the photoconductor gear 82, the wire 61 passes through the through hole 96*b* to attach the second connecting portion 61*b* to the attaching portion 96*a*. Then, the wire 61 passes through the spring 73 to go through the drive side inserting opening portion 83 of the photoconductor gear 82, and the spring 73 enters to the drive side opening 87 of the drive side cylindrical portion 82*a*, as illustrated in FIG. 3.

Further, while the spring 73 is placed in the drive side opening 87 of the drive side cylindrical portion 82*a*, the drive side spherical portion 91 of the drive connecting member 90 is inserted into the drive side opening 87. Then, the first drive side projection 94*a* is inserted into the first guide groove 86*a*, and then the second drive side projection 94*b* is inserted into the second guide groove 86*b*. Accordingly, the spring bearing 96 of the drive connecting member 90 is engaged to the spring 73. By so doing, the one end of the spring 73 is attached to the drive connecting member 90.

Before the first drive side projection 94*a* and the second drive side projection 94*b* are placed at the communication portion 84, the drive connecting member 90 is pushed in the drive side cylindrical portion 82*a* against the biasing force of the spring 73. As illustrated in FIG. 12, when the drive connecting member 90 is pushed in the drive side cylindrical portion 82*a* until the first drive side projection 94*a* and the second drive side projection 94*b* are located on the communication portion 84, the drive connecting member 90 is rotated in a direction indicated by arrow a in FIG. 12. Accordingly, as illustrated in FIG. 13, the first drive side projection 94*a* and the second drive side projection 94*b* move to the drive side grooves 85 via the communication portion 84. As the first drive side projection 94*a* and the second drive side projection 94*b* contact the respective side faces of the drive side grooves 85, rotation of the drive connecting member 90 is regulated. Then, the drive connecting member 90 is released. Consequently, application of the biasing force of the spring 73 moves the drive connecting member 90 in a direction indicated by arrow B1 (the coupling member side), so that the first drive side projection 94*a* and the second drive side projection 94*b* are inserted into the respective drive side grooves 85, as illustrated in FIG. 14. Accordingly, the drive connecting member 90 is attached to the photoconductor gear 82.

Figure 15:
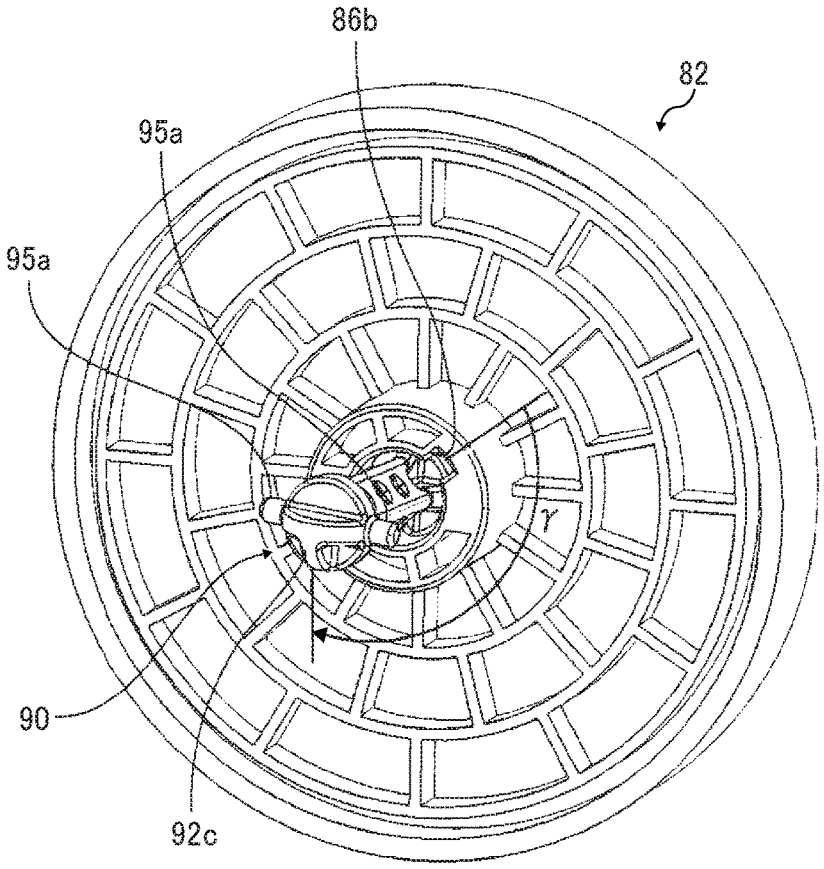
FIG. 15 is a perspective view illustrating a state in which the drive connecting member is attached to the photoconductor gear.

FIG. 15 is a perspective view illustrating a state in which the drive connecting member 90 is attached to the photoconductor gear 82.

In the present embodiment, as described above, the height of the first drive side projection 94*a* and the height of the second drive side projection 94*b* are different from each other and the depth of the second guide groove 86*b* is smaller. According to this configuration, the second guide groove 86*b* receives the second drive side projection 94*b* alone. Accordingly, the drive connecting member 90 is attached to the photoconductor gear 82 at the predetermined phase specified to the photoconductor gear 82. As a result, as illustrated in FIG. 15, the drive connecting member 90 is attached to the photoconductor gear 82 such that the third driven side large circle 92*c* of the driven side spherical portion 92 is located constantly at a position where the third driven side large circle 92*c* is rotated by an angle γ in the clockwise direction to the second guide groove 86*b*.

Figure 16:
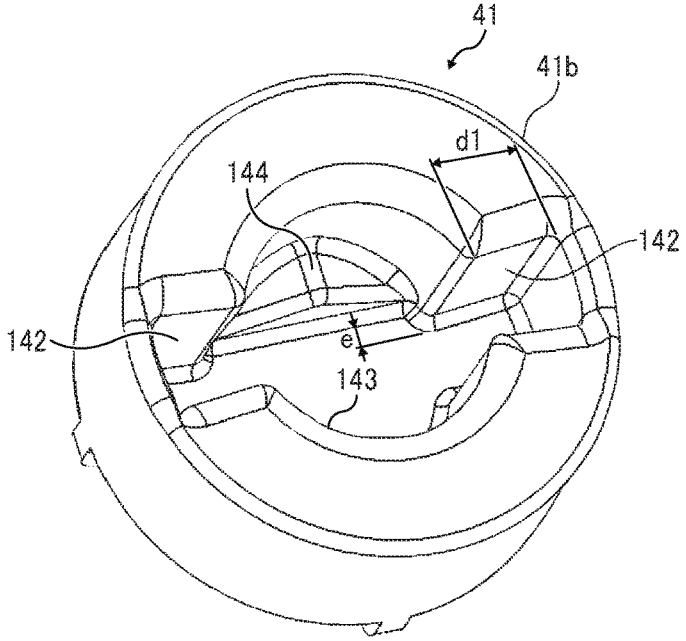
FIG. 16 is a perspective view illustrating the coupling member.
Figure 17:
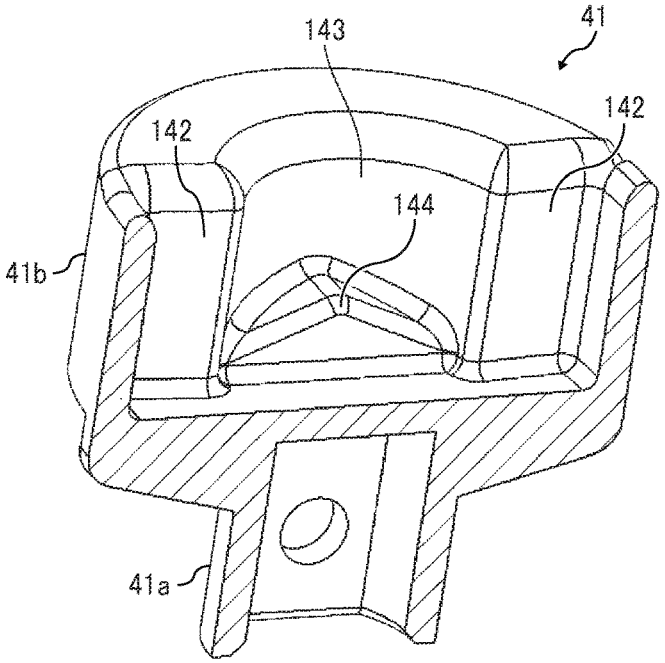
FIG. 17 is a cross sectional perspective view illustrating the coupling member of FIG. 16.

FIG. 16 is a perspective view illustrating the coupling member 41. FIG. 17 is a cross sectional perspective view illustrating the coupling member 41.

The coupling member 41 includes the shaft inserting portion 41*a* and the driven side cylindrical portion 41*b*. It is preferable that the coupling member 41 is formed of a polyacetal resin (POM) having excellent mechanical strength, and good wear resistance and slidability.

The driven side cylindrical portion 41*b* of the coupling member 41 has an opening facing a drive side, and has a driven side opening 143 into which the driven side spherical portion 92 of the drive connecting member 90 is inserted. Further, two driven side grooves 142 are provided in the driven side cylindrical portion 41*b* at an interval of 180 degrees in the rotation direction. The driven side projections 95*a* of the drive connecting member 90 are inserted into the respective driven side grooves 142. A groove depth d1 of each of the driven side grooves 142 is slightly deeper than the height h1 of each of the driven side projections 95*a*. Further, a phase matching projection 144 is formed on a bottom surface of the driven side spherical portion 92, at a position shifted from the rotation center.

As illustrated in FIG. 17, the phase matching projection 144 has a mountain shape in which the height becomes gradually lower from a central portion toward an outside. Further, as illustrated in FIG. 16, the phase matching projection 144 is formed up to a position retracted by a length of e mm from the position of the driven side grooves 142.

Figure 18:
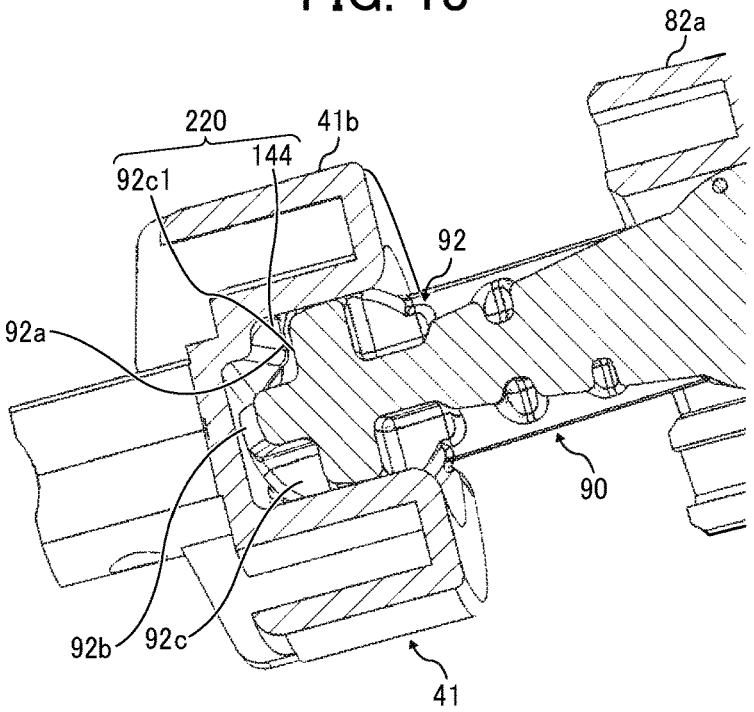
FIG. 18 is a cross sectional perspective view illustrating a state in which the driven side spherical portion of the drive connecting member is inserted into the drive side cylindrical portion of the coupling member.

FIG. 18 is a cross sectional perspective view illustrating a state in which the driven side spherical portion 92 of the drive connecting member 90 is inserted into the driven side cylindrical portion 41*b* of the coupling member 41.

When the coupling member 41 and the drive connecting member 90 are brought to be connected in a state in which the phase matching projection 144 is positioned in a lower part in FIG. 18, the third driven side large circle 92*c* of the driven side spherical portion 92 contacts against the phase matching projection 144. As a result, the driven side spherical portion 92 cannot be inserted into the driven side cylindrical portion 41*b* of the coupling member 41 and the driven side projections 95*a* cannot be inserted into the driven side grooves 142, and therefore drive transmission cannot be connected. In other words, when the phase in the rotation direction of the phase matching projection 144 is matched with a cut portion 92*c*1 of the third driven side large circle 92*c* of the driven side spherical portion 92, the driven side spherical portion 92 is inserted into the driven side cylindrical portion 41*b*, and the driven side projections 95*a* are inserted into the driven side grooves 142, so that the drive transmission is connected. That is, in the present embodiment, the phase matching projection 144 and the cut portion 92*c*1 of the third driven side large circle 92*c* of the driven side spherical portion 92 configure a second phase matching device 220.

As described above, in the present embodiment, the photoconductor gear 82 and the drive connecting member 90 are attached at a predetermined phase, and the drive transmission between the drive connecting member 90 and the coupling member 41 is connected at a predetermined phase. As a result, the drive transmission between the photoconductor gear 82 and the coupling member 41 can be connected at a predetermined phase.

As described above, the photoconductor gear 82 is a resin molded item, and the shape cannot become a perfect circle and slightly becomes an elliptical shape because of sink marks, for example. As a result, the photoconductor gear 82 has speed variation for one rotation period. In a case in which the photoconductor gear 82 has the speed variation, the photoconductor drum 2 also has speed variation according to the speed variation of the photoconductor gear 82, and therefore the image is expanded and contracted according to the speed variation of the photoconductor drum 2. That is, when the speed of the photoconductor drum 2 is fast, the image to which any image data has been written or transferred is expanded. By contrast, when the speed of the photoconductor drum 2 is slow, the image to which any image data has been written or transferred is contracted.

Further, in the photoconductor drum 2 to which the coupling member 41 is attached, speed variation for one rotation period is caused due to eccentricity of the photoconductor drum 2. Therefore, the speed variation of the photoconductor drum 2 includes superimposition of the speed variation component for one rotation period of the photoconductor drum 2 and the speed variation component for one rotation period of the photoconductor gear 82. In order to eliminate the speed variation of the photoconductor drum 2, the speed variation of the photoconductor drum 2 is previously measured, so as to control a drive motor to eliminate the speed variation of the photoconductor drum 2 based on the measurement result.

In the present embodiment, the driven side projections 95*a* are provided at an interval of an angle of 180 degrees in the rotation direction. Therefore, even when the coupling member 41 is rotated by 180 degrees from a state in which the phases of the driven side projections 95*a* and the phases of the driven side grooves 142 in the rotation direction are matched, the phases of the driven side projections 95*a* and the phases of the driven side grooves 142 in the rotation direction become matched. As a result, the photoconductor drum 2 is likely to be assembled to the apparatus body 100 in a state in which the phase is shifted by an angle of 180 degrees with respect to the measurement of the speed variation of the photoconductor drum 2. Accordingly, even if the above-described drive transmission is applied, the speed variation of the photoconductor drum 2 is not eliminated, and it is likely that the image is deteriorated.

As described above, in the present embodiment, the photoconductor gear 82 and the drive connecting member 90 are attached at a predetermined phase, and the drive transmission between the drive connecting member 90 and the coupling member 41 is connected at a predetermined phase. According to this configuration, the photoconductor drum 2 is attached to apparatus body 100 at the phase obtained when the speed variation of the photoconductor drum 2 is measured. Accordingly, the above-described drive control is conducted to eliminate the speed variation of the photoconductor drum 2 based on the measurement result. As a result, the image forming apparatus 1000 can enhance high image quality.

In the present embodiment, as illustrated in FIG. 1, the process cartridge 1 including the photoconductor drum 2 moves in a direction perpendicular to the axial direction of photoconductor drum 2 when the process cartridge 1 is attached to and detached from the apparatus body 100 of the image forming apparatus 1000. Therefore, when the process cartridge 1 is detached or removed from the apparatus body 100, the driven side spherical portion 92 of the drive connecting member 90 is removed from the driven side cylindrical portion 41*b* of the coupling member 41 so as to release or disengage drive connection of the drive side and the rotary body side. Further, when the process cartridge 1 is attached to the apparatus body 100, the drive connecting member 90 is retracted to avoid the driven side spherical portion 92 of the drive connecting member 90 from contacting the coupling member 41.

Figure 19:
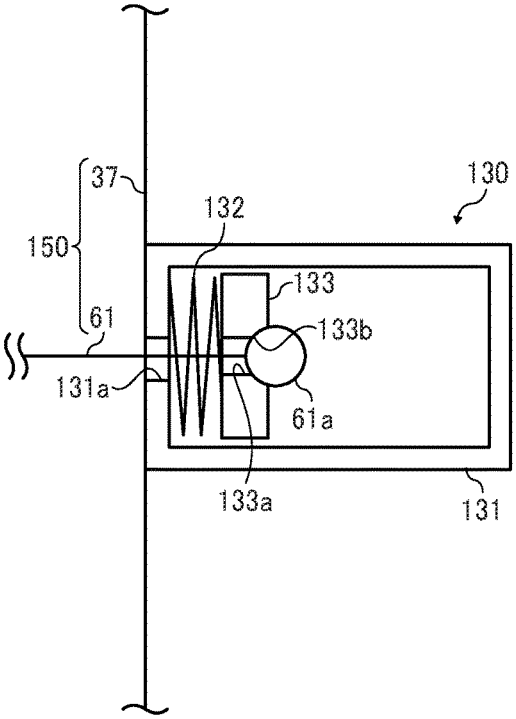
FIG. 19 is a cross sectional perspective view illustrating a state in which a driven side spherical portion of the coupling member is inserted into a driven side cylindrical portion of the coupling member.

In order to address this inconvenience, the image forming apparatus 1000 according to the present embodiment includes a retraction mechanism 150 in FIG. 19. When the process cartridge 1 is attached to or detached from the apparatus body 100 of the image forming apparatus 1000, the retraction mechanism 150 causes the drive connecting member 90 to move to the photoconductor gear side, so that the drive connecting member 90 is retracted to a releasing position where the drive connection of the drive connecting member 90 and the coupling member 41 is released. To be more specific, the retraction mechanism 150 includes the wire 61 and the cover 37 that functions as an operating member. As illustrated in FIGS. 2 and 3, one end of the wire 61 is connected to the drive connecting member 90 and the opposed end of the wire 61 is connected to the cover 37. Consequently, the wire 61 moves the drive connecting member 90 to the photoconductor gear side along with opening of the cover 37 against the biasing force of the spring 73, so that the drive connecting member 90 is located at the releasing position.

FIG. 19 illustrates an example of a wire attaching device 130 that is mounted on the cover 37 to which the first connecting portion 61*a* of the wire 61 is attached.

As illustrated in FIG. 19, the wire attaching device 130 functions as a connection target body and is mounted on the cover 37. The wire attaching device 130 includes a housing 131, a tension spring 132 that functions as a linear body biasing member, and a base 133. The base 133 is disposed slidable in the housing 131 in the left and right directions in FIG. 19. The housing 131 contains the base 133 and the tension spring 132 and includes a box and a lid. The box of the housing 131 has an opening on one surface that extends perpendicular to the drawing sheet. The lid is attached to the box to cover the opening of the box. A hole 131*a* is formed in the side face of the box on the apparatus body side in the left side in FIG. 19. The hole 131*a* extends toward the opening side of the box (in the direction perpendicular to the drawing sheet) to communicate with the end of the opening side of the box.

A hole 133*a* is formed in the base 133 at the center. The wire 61 passes through the hole 133*a*. The hole 133*a* also extends in the direction perpendicular to the drawing sheet to communicate with one end of the base 133. A recess 133*b* is formed in an opposed side of the base 133 that is a side opposite the apparatus body side on the right side in FIG. 19. The recess 133*b* is spherically curved and holds the first connecting portion 61*a* of the wire 61.

The tension spring 132 is mounted between the apparatus body side face of the housing 131 and the base 133. The wire 61 passes through the tension spring 132.

To assemble the wire 61 to the wire attaching device 130, the wire 61 is inserted into the loop of the tension spring 132, and then the base 133 is inserted and placed between the first connecting portion 61*a* and the tension spring 132 with the wire 61 inserted. To be more specific, the wire 61 is inserted from one end of the base 133 into the hole 131*a* of the base 133 into which the wire 61 is inserted. By so doing, the base 133 is inserted and placed between the tension spring 132 with the wire 61 therethrough and the first connecting portion 61*a*. Then, the wire 61 having the tension spring 132 and the base 133 attached thereto is inserted into the hole 131*a* communicated with the opening end of the box of the housing 131, so as to pass the wire 61 therethrough. By so doing, the tension spring 132 and the base 133 are attached to the box of the housing 131. Consequently, by attaching the lid of the housing 131 to the box of the housing 131, the wire 61 is assembled to the wire attaching device 130.

The biasing force of the tension spring 132 is smaller than the biasing force of the spring 73 illustrated in FIGS. 2 and 3. Therefore, according to the biasing force of the tension spring 132 applied to the base 133 via the wire 61, the tension spring 132 is stored in the housing 131 in a compressed state.

Figure 20A:
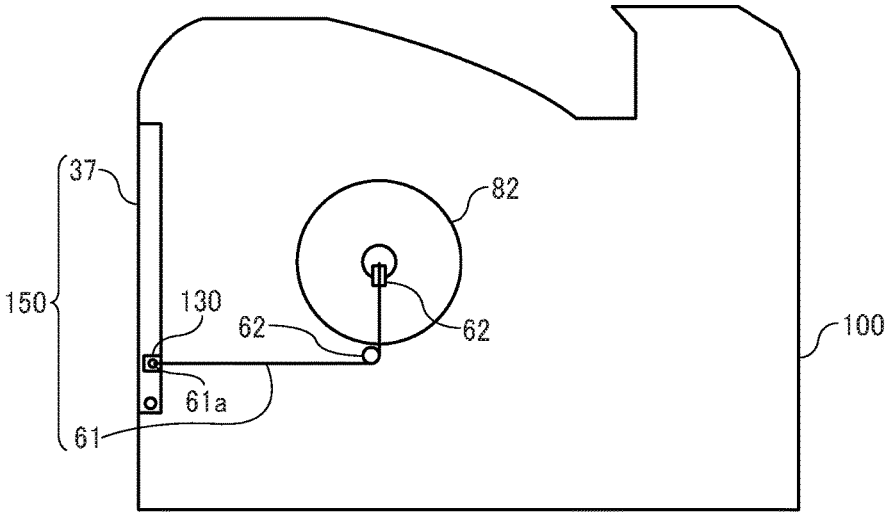
FIG. 20A is a diagram illustrating an example of installation of a wire in an apparatus body of the image forming apparatus when a cover is closed.
Figure 20B:
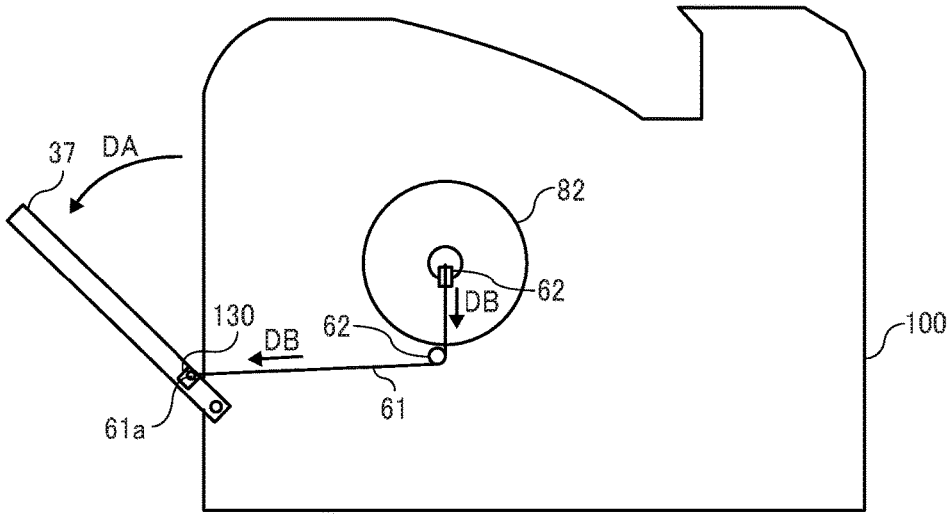
FIG. 20B is a diagram illustrating an example of installation of the wire in the apparatus body of the image forming apparatus when the cover is open.
Figure 21A:
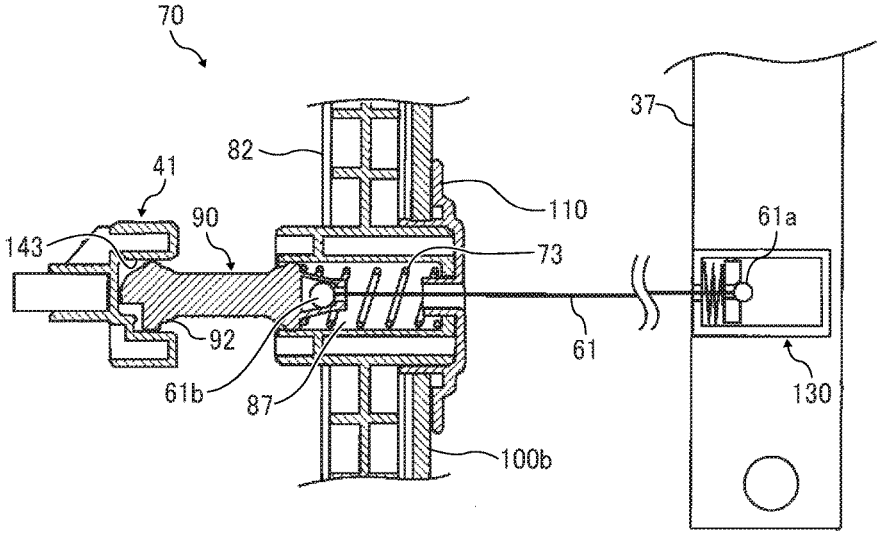
FIG. 21A is a diagram illustrating a wire attaching portion and the drive transmission device when the cover is closed.
Figure 21B:
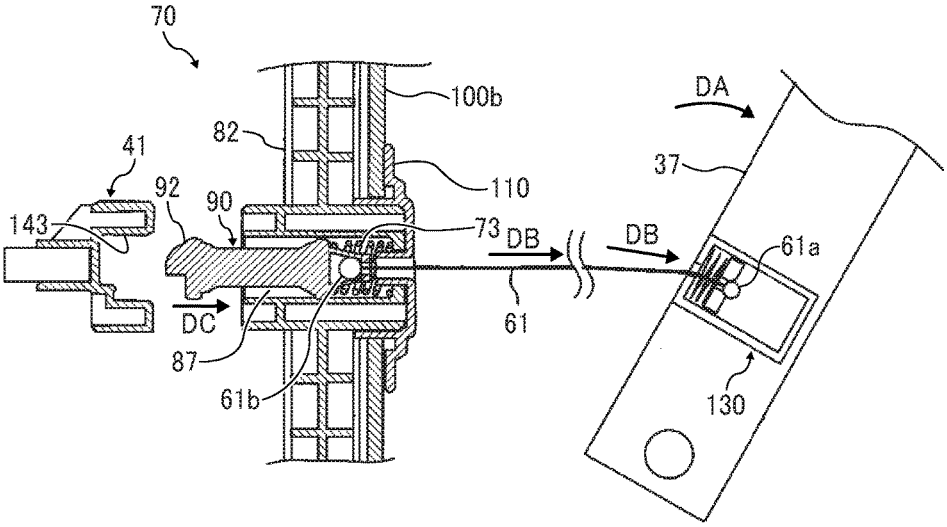
FIG. 21B is a diagram illustrating the wire attaching portion and the drive transmission device when the cover is open.

FIG. 20A is a diagram illustrating an example of installation of the wire 61 in the apparatus body 100 of the image forming apparatus 1000 when the cover 37 is closed. FIG. 20B is a diagram illustrating an example of installation of the wire 61 in the apparatus body 100 of the image forming apparatus 1000 when the cover 37 is open. FIG. 21A is a diagram illustrating the wire attaching device 130 and the drive transmission device 70 when the cover 37 is closed. FIG. 21B is a diagram illustrating the wire attaching device 130 and the drive transmission device 70 when the cover 37 is open.

As illustrated in FIGS. 20A and 20B, the wire 61 is installed at a predetermined position in the apparatus body 100 of the image forming apparatus 1000, guided by a guide 62. In the present embodiment, the guide 62 is mounted on a position opposite the photoconductor gear 82 but the position of the guide 62 is not limited thereto. For example, the wire 61 may be guided by an inner circumferential surface of the regulating portion 112 of the bearing 110.

However, by providing the guide 62 to the position facing the photoconductor gear 82, the second connecting portion 61*b* of the wire 61 is shifted in parallel to the axial direction. Therefore, the drive connecting member 90 may be preferably moved smoothly.

As illustrated in FIG. 20B, as the cover 37 is brought to open (in a direction in a direction indicated by arrow DA), the wire 61 is pulled by the cover 37 in a direction indicated by arrow DB.

In addition, as illustrated in FIG. 21B, as the wire 61 is pulled along with opening of the cover 37, the second connecting portion 61*b* that is connected to the drive connecting member 90 pulls the drive connecting member 90 toward the photoconductor gear side. Consequently, the drive connecting member 90 moves in a direction indicated by arrow DC in FIG. 21B, against the biasing force of the spring 73 in a direction indicated by arrow DC (the coupling member side), so that the driven side spherical portion 92 is pulled out from the driven side cylindrical portion 41*b* of the coupling member 41. Accordingly, drive connection of the coupling member 41 and the drive connecting member 90 is released, and the process cartridge 1 is moved in the direction perpendicular to the axial direction. By so doing, the process cartridge 1 is pulled out from the apparatus body 100 of the image forming apparatus 1000.

Further, when the process cartridge 1 is attached to the apparatus body 100 of the image forming apparatus 1000, the cover 37 is located at the open position. Therefore, the drive connecting member 90 is retracted at the releasing position. Accordingly, the process cartridge 1 is attached to the apparatus body 100 of the image forming apparatus 1000 without the coupling member 41 contacting the driven side spherical portion 92.

Further, it is preferable that the axial length of each of the drive side grooves 85 (i.e., a length of each of the drive side grooves 85 from the retaining portion 85*a* to the communication portion 84) is greater than the amount of movement of the drive connecting member 90 along with opening or closing of the cover 37. With this configuration, even when the drive connecting member 90 is located at the releasing position, the first drive side projection 94*a* and the second drive side projection 94*b* remain within the drive side grooves 85. Therefore, when the drive connecting member 90 is located at the releasing position, even if a force to rotate the drive connecting member 90 is applied due to certain reasons, the first drive side projection 94*a* and the second drive side projection 94*b* in the drive side grooves 85 do not move to the guide grooves (i.e., the first guide groove 86*a* and the second guide groove 86*b*). Accordingly, when the drive connecting member 90 is located at the releasing position, the drive connecting member 90 does not come out from the photoconductor gear 82.

After the process cartridge 1 has been placed in the apparatus body 100 of the image forming apparatus 1000, as the cover 37 approaches the closed position, the force of the wire 61 to pull the drive connecting member 90 to the releasing position weakens. Consequently, with the biasing force of the spring 73, the drive connecting member 90 moves toward the coupling member 41. When the cover 37 reaches the closed position, as illustrated in FIG. 21A, the driven side spherical portion 92 of the drive connecting member 90 enters into the driven side cylindrical portion 41*b* of the coupling member 41, so that the drive connecting member 90 and the coupling member 41 are drivably connected.

As described above, in the present embodiment, the wire 61 is connected to the drive connecting member 90 directly. By so doing, a retracting member to cause the drive connecting member 90 to move between the drive coupling position at which the drive connecting member 90 and the coupling member 41 are drivably connected and the releasing position may be removed. Accordingly, the configuration of the present embodiment can reduce the number of parts, and therefore can reduce the cost and size of the image forming apparatus 1000. In the present embodiment, as illustrated in FIGS. 20A and 20B, the guide 62 is provided at a position facing the photoconductor gear 82. However, the function of the guide 62 is not limited thereto. For example, the guide 62 may simply function to guide the wire 61. Therefore, when compared with a configuration in which a retracting member that needs to cause the drive connecting member 90 to move to the retracted position, the guide 62 can reduce the size. Consequently, when compared with a configuration in which the drive transmission device having the retracting member, the configuration of the present embodiment can reduce the size of the drive transmission device and the image forming apparatus 1000.

When the process cartridge 1 is inserted into the apparatus body 100 of the image forming apparatus 1000, in a case in which the phase of the coupling member 41 that is attached to the photoconductor drum shaft 40*a* does not match with the phase of the drive connecting member 90, the driven side projections 95*a* contact the edge portion of the driven side cylindrical portion 41*b* of the coupling member 41 or the third driven side large circle 92*c* contacts the phase matching projection 144. In this state, as the process cartridge 1 is further inserted into the apparatus body 100, the drive connecting member 90 moves toward the far side of the image forming apparatus 1000 while compressing the spring 73. According to this configuration, the cover 37 closes even if the coupling member 41 and the drive connecting member 90 are not drivably connected.

FIG. 22 is a diagram illustrating a state in which the cover 37 is closed when the phase of the coupling member 41 attached to the photoconductor drum shaft 40*a* and the phase of the drive connecting member 90 do not match.

In the present embodiment, the first connecting portion 61*a* of the wire 61 is biased by the tension spring 132 in a direction in which the cover 37 opens (i.e., toward the outside of the image forming apparatus 1000). Therefore, when the cover 37 is closed in a state in which the drive connecting member 90 is located at the far side from the drive coupling position without connection of the driving force, the tension spring 132 extends to move the first connecting portion 61*a* toward the outside of the image forming apparatus 1000. According to this configuration, even when the cover 37 is closed without connection of the driving force, the tension state may be maintained without loosening the wire 61. Accordingly, any failure, e.g., the wire 61 being caught by a part or component in the apparatus body 100 of the image forming apparatus 1000, can be restrained or prevented.

As the drive connecting member 90 is rotated together with rotation of the photoconductor gear 82 while not being drivably coupled with the photoconductor gear 82, the phases of the driven side projections 95*a* match with the phase of the driven side grooves 142. Then, the coupling of the third driven side large circle 92*c* and the phase matching projection 144 is released (uncoupled), so that the phase of the drive connecting member 90 and the phase of the coupling member 41 match with each other. Consequently, the drive connecting member 90 moves to the coupling member 41 by the biasing force applied by the spring 73, the driven side spherical portion 92 is inserted into the driven side opening 143, and the driven side projections 95*a* is inserted into the driven side grooves 142. Accordingly, the drive transmission of the drive connecting member 90 and the coupling member 41 is connected with the predetermined phase, and the driving force is transmitted from the drive connecting member 90 to the coupling member 41.

When there is a gap between the rotation center of the photoconductor gear 82 and the rotation center of the photoconductor drum shaft 40*a* (hereinafter, the gap is referred to as an axis misalignment), the drive connecting member 90 is inclined to connect the drive transmission. In the present embodiment, the drive side spherical portion 91 (i.e., a first inserting body) of the drive connecting member 90 that is inserted into the drive side cylindrical portion 82*a* of the photoconductor gear 82 has a spherical shape, and the driven side spherical portion 92 (i.e., a second inserting body) of the drive connecting member 90 that is inserted into the driven side opening 143 of the coupling member 41 also has a spherical shape. Accordingly, in a case in which there is the axis misalignment, the drive connecting member 90 can be smoothly inclined, and the axis misalignment can be preferably absorbed. To be more specific, the arc-shaped surfaces of the first drive side large circle 91*a*, the second drive side large circle 91*b*, and the third drive side large circle 91*c* of the drive side spherical portion 91 that are inserted into the drive side cylindrical portion 82*a* of the photoconductor gear 82 smoothly slide on the inner circumferential surface of the drive side opening 87, and the drive connecting member 90 is smoothly inclined with respect to the photoconductor gear 82. Further, the arc-shaped surfaces of the first driven side large circle 92*a*, the second driven side large circle 92*b*, and the third driven side large circle 92*c* of the driven side spherical portion 92 that are inserted into the driven side opening 143 of the coupling member 41 smoothly slide on the inner circumferential surface of the driven side opening 143 and the bottom surface of the driven side cylindrical portion 41*b*. Therefore, the drive connecting member 90 is smoothly inclined with respect to the coupling member 41. Accordingly, the drive connecting member 90 is smoothly inclined and can restrain the axis misalignment.

Further, the second connecting portion 61*b* of the wire 61 contacts the photoconductor side edge portion of the through hole 96*b* of the drive connecting member 90 by the biasing force of the tension spring 132. Since the second connecting portion 61*b* has a spherical shape, the second connecting portion 61*b* does not hinder inclination of the drive connecting member 90.

Figure 23A:
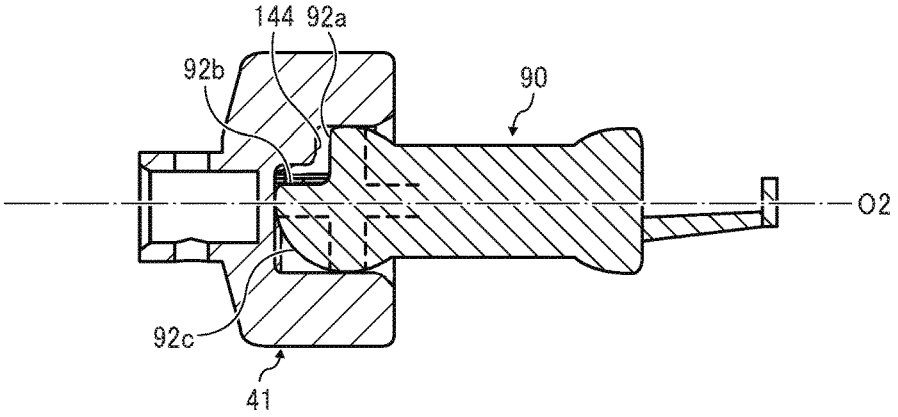
FIGS. 23A, 23B and 23C are cross sectional views illustrating the coupling member and the drive connecting member, cut in a direction perpendicular to a protruding direction of a driven side projection.
Figure 23B:
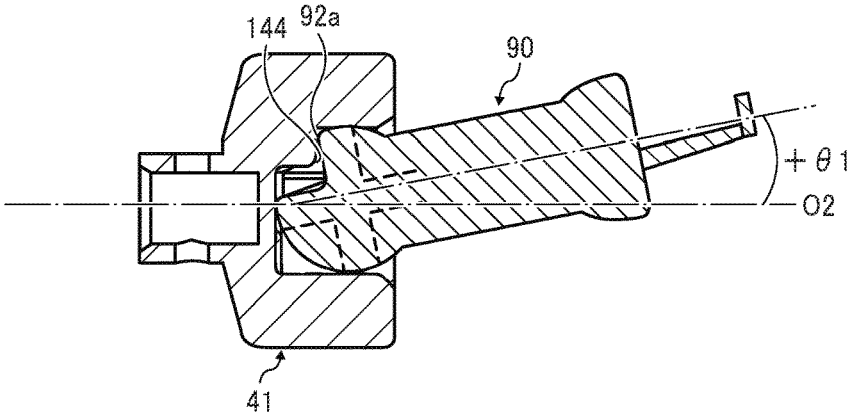
Figure 23C:
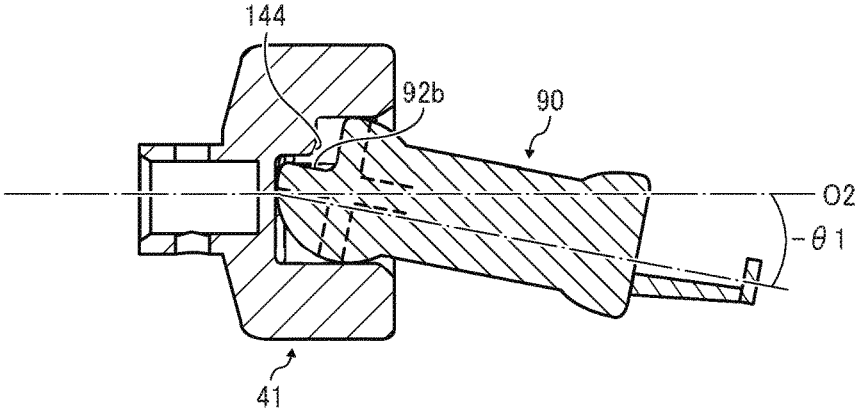

FIGS. 23A, 23B and 23C are cross sectional views illustrating the coupling member 41 and the drive connecting member 90, cut in the direction perpendicular to the protruding direction of the driven side projections 95*a*.

As illustrated in FIG. 23A, when the drive connecting member 90 is not inclined, the phase matching projection 144 has a height having a predetermined gap with respect to a side surface of the first driven side large circle 92*a*. This predetermined gap causes the first driven side large circle 92*a* not to come in contact with the phase matching projection 144 even when the drive connecting member 90 is inclined by a maximum inclination angle +θ1, the maximum inclination angle being in the direction perpendicular to the protruding direction of the driven side projections 95*a* of the drive connecting member 90, as illustrated in FIG. 23B.

Further, as illustrated in FIG. 16, the phase matching projection 144 is not formed up to the position flush with the side surface of the driven side grooves 142, and is retracted by a length of e mm from the side surface of the driven side grooves 142. Therefore, when the drive connecting member 90 is not inclined, as illustrated in FIG. 23A, the predetermined gap is formed between the side surface of the phase matching projection 144 and the side surface of the second driven side large circle 92*b*. This predetermined gap causes the second driven side large circle 92*b* not to come in contact with the side surface of the phase matching projection 144, even when the drive connecting member 90 is inclined by the maximum inclination angle −θ1, the maximum inclination angle being in the direction perpendicular to the protruding direction of the driven side projection 95*a* of the drive connecting member 90, as illustrated in FIG. 23C.

Figure 24A:
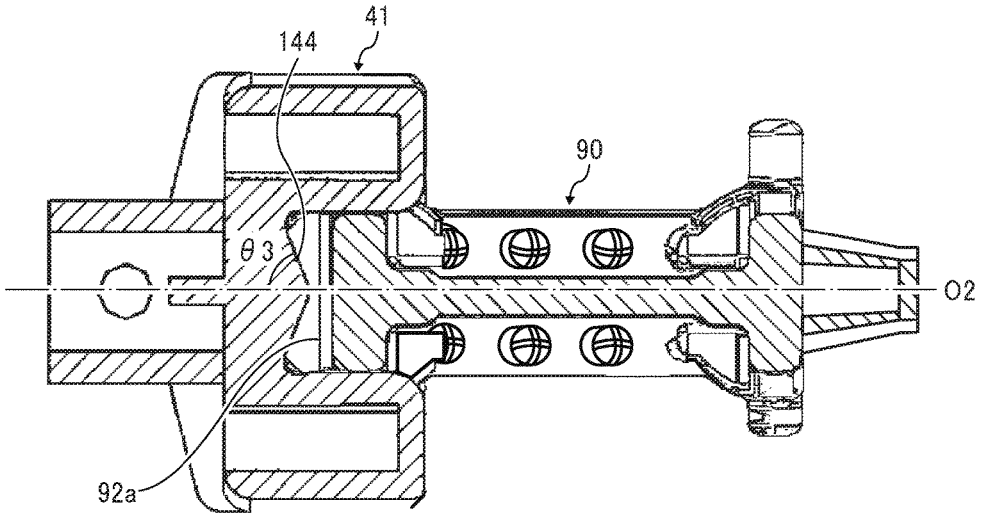
FIGS. 24A, 24B and 24C are cross sectional views illustrating the coupling member and the drive connecting member, cut in a direction parallel to the protruding direction of the driven side projection.
Figure 24B:
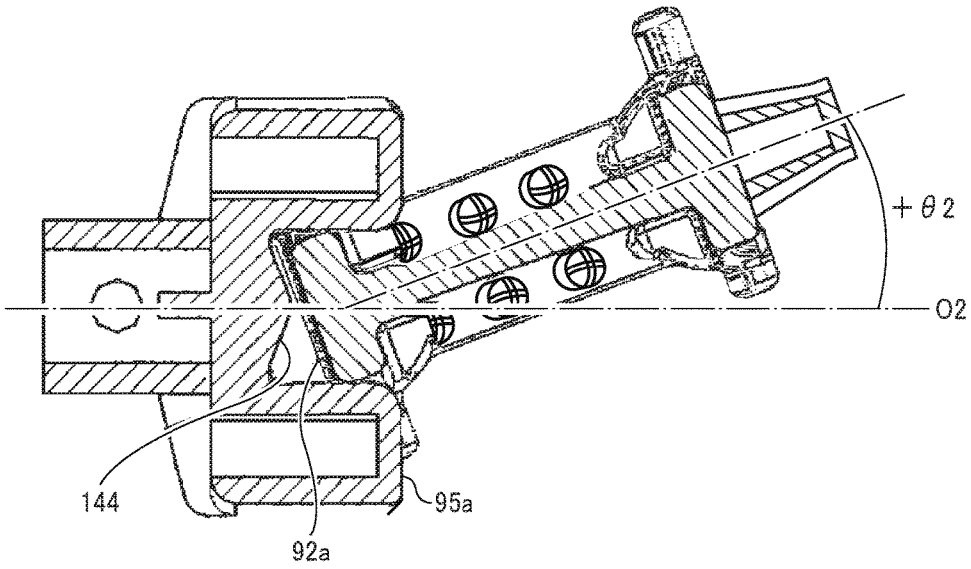
Figure 24C:
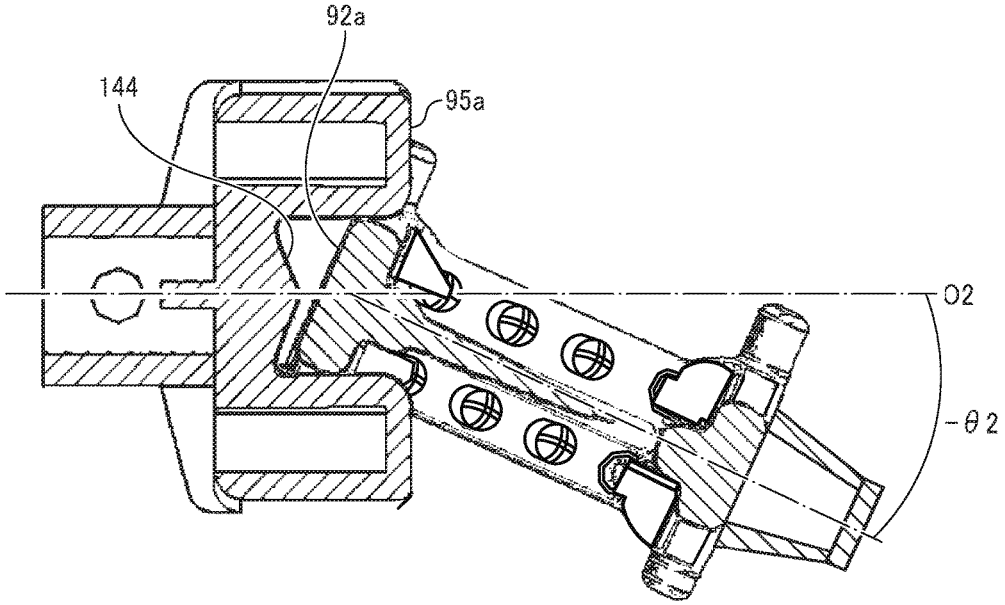

FIGS. 24A, 24B and 24C are cross sectional views illustrating the coupling member 41 and the drive connecting member 90, cut in a direction parallel to the protruding direction of the driven side projections 95*a*.

The phase matching projection 144 has a mountain shape where the height of the cross section becomes lower from the center toward a distal end portion, as illustrated in FIG. 24A. Then, an inclination angle θ3 of an inclined surface of the phase matching projection 144 is set to an angle that causes the side surface of the first driven side large circle 92*a* not to abut against the phase matching projection 144, when the drive connecting member 90 is inclined by a maximum inclination angle θ2 in a direction parallel to the protruding direction of the driven side projection 95*a*, as illustrated in FIGS. 24B and 24C.

As described above, in the present embodiment, the phase matching projection 144 does not impede inclination of the drive connecting member 90, and thus the axis misalignment can be preferably absorbed by the drive connecting member 90. It is to be noted that the maximum inclination angle of the drive connecting member 90 is an angle of inclination regulated due to abutment of the connecting portion 93 of the drive connecting member 90 against the coupling member 41 at the edge portion of the driven side cylindrical portion 41*b* thereof or against the photoconductor gear 82 at the edge portion of the drive side cylindrical portion 82*a* thereof.

It is to be noted that a reference letter "O2" indicates a shaft core of the coupling member 41 in FIGS. 23A, 23B, 23C, 24A, 24B and 24C. Specifically, FIGS. 23A through 23C indicate that, even when the drive connecting member 90 is inclined by an angle of +θ1 or −θ1, the second driven side large circle 92*b* does not contact with the phase matching projection 144. Further, FIGS. 24A through 24C indicated that, even when the drive connecting member 90 is inclined by an angle of +θ2 or −θ2, the side surface of the first driven side large circle 92*a* does not abut against the phase matching projection 144.

Further, the configuration to match the phase of the driven side (the phases between the coupling member 41 and the drive connecting member 90) may be the same as the configuration to match the phase of the drive side (the phases between the photoconductor gear 82 and the drive connecting member 90). That is, the lengths of the driven side projections 95*a* are differentiated from each other and the groove depths of the driven side grooves 142 are differentiated from each other. Therefore, the driven side projections 95*a* is not inserted into any groove other than the predetermined driven side grooves 142.

Further, in the present embodiment, the first drive side projection 94*a* and the second drive side projection 94*b* of the drive connecting member 90 that receive the driving force transmitted from the photoconductor gear 82 has a columnar shape, and the driven side projections 95*a* that transmit the driving force to the coupling member 41 also has a columnar shape. Accordingly, the projections of the present embodiment (i.e., the first drive side projection 94*a*, the second drive side projection 94*b*, and the driven side projections 95*a*) are more restrained from the angular speed variations when compared with a comparative configuration in which the drive side projections and the driven side projections have hemisphere shapes.

Now, a specific description is given using the drawings as follows.

Figure 25A:
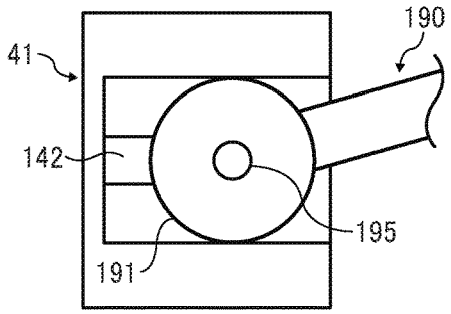
FIGS. 25A, 25B and 25C are diagrams illustrating a drive transmission operation of a drive connecting member and a coupling member of a comparative drive transmission device.
Figure 25B:
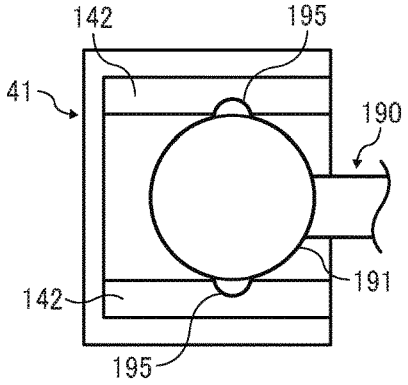
Figure 25C:
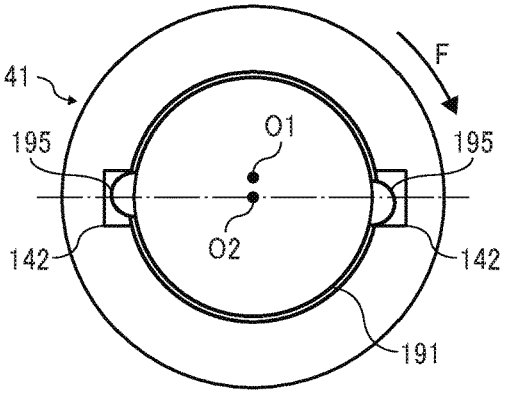
Figure 26A:
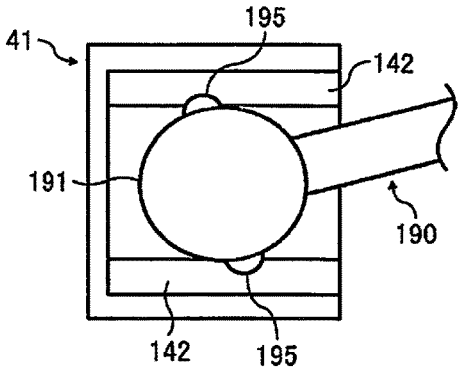
FIGS. 26A, 26B and 26C are diagrams illustrating states in which the drive connecting member and the coupling member of the comparative drive transmission device are rotated by an angle of 90 degrees from the states of FIGS. 25A, 25B and 25C, respectively.
Figure 26B:
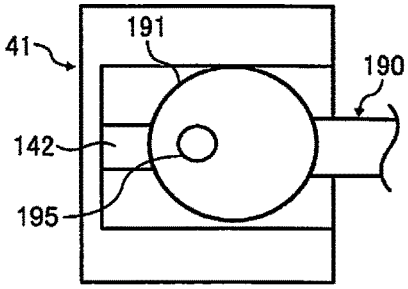
Figure 26C:
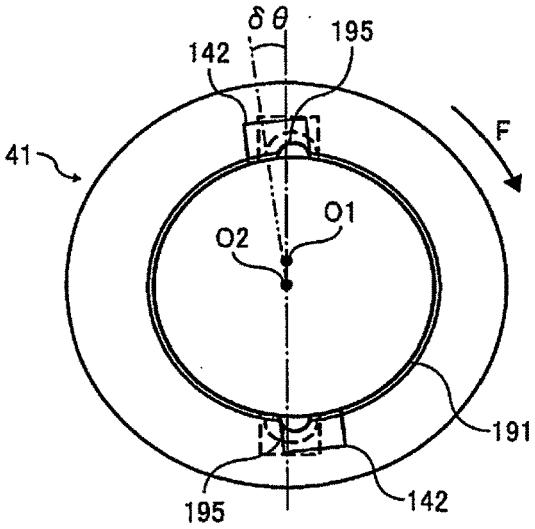

FIGS. 25A, 25B and 25C are diagrams illustrating drive transmission operations of a comparative drive connecting member 190 and the coupling member 41 of a comparative drive transmission device. Specifically, FIG. 25A is a diagram illustrating the coupling member 41 and the comparative drive connecting member 190, viewed from a direction perpendicular to an angularly shifted direction of the comparative drive connecting member 190. FIG. 25B is a diagram illustrating the coupling member 41 and the comparative drive connecting member 190, viewed from the top of FIG. 25A. FIG. 25C is a diagram illustrating the coupling member 41 and the comparative drive connecting member 190, viewed from the axial direction. Further, FIGS. 26A, 26B and 26C are diagrams illustrating states in which the comparative drive connecting member 190 and the coupling member 41 of the comparative drive transmission device are rotated by an angle of 90 degrees from the states of FIGS. 25A, 25B and 25C, respectively. Specifically, FIG. 26A is a diagram illustrating the coupling member 41 and the comparative drive connecting member 190, viewed from a direction perpendicular to the angularly shifted direction of the comparative drive connecting member 190. FIG. 26B is a diagram illustrating the coupling member 41 and the comparative drive connecting member 190, viewed from the top of FIG. 26A. FIG. 26C is a diagram illustrating the coupling member 41 and the comparative drive connecting member 190, viewed from the axial direction.

It is to be noted that, in FIGS. 25A, 25B, 25C, 26A, 26B and 26C, a reference letter "O2" indicates the shaft core of the coupling member 41, a reference letter "O1" indicates a shifted shaft core, and reference numeral "191" indicates a shape of a coupled portion formed by coupling of the coupling member 41 and the comparative drive connecting member 190.

In a case in which driven side projections 195 have a hemisphere shape, each of the driven side projections 195 forms an arc shape in which a downstream end of the rotation direction of the driven side projections 195, which is a groove abutting portion abutting against a side surface of the driven side grooves 142, is positioned to an upstream side of the rotation direction, as going to the top, as illustrated in FIG. 25C. As illustrated in FIGS. 25A through 25C, when the protruding direction of the driven side projections 195 is a direction perpendicular to an axis misalignment direction, substantially the entire driven side projections 195 enter the driven side grooves 142. Therefore, in this case, driven side spherical portion sides of the driven side projections 195 abut against respective side surfaces of the driven side grooves 142, as illustrated in FIG. 25C.

From this state, when the comparative drive connecting member 190 is rotated in arrow F direction in FIG. 25C, the driven side projection 195 on the left side of FIG. 25C is moved inside the driven side groove 142 in the axial direction in a direction of being separated from the photoconductor gear 82. Further, the driven side projection 195 on the right side of FIG. 25C is moved in the driven side groove 142 in the axial direction in a direction of approaching the photoconductor gear 82. At this time, as respective entering amounts of the driven side projections 195 to the driven side grooves 142 are decreased, the abutting positions of the driven side projections 195 against the driven side groove side surfaces are changed to the top side. In the case in which the driven side projections 195 have a hemisphere shape, the downstream end of the rotation direction of the driven side projection 195, which abuts against the driven side groove 142, is positioned to the upstream side of the rotation direction, as approaching the top, as described above. Therefore, as illustrated in FIG. 26C, even when the comparative drive connecting member 190 is rotated by an angle of 90 degrees, the coupling member 41 is not rotated by an angle of 90 degrees and is located at a position retracted in the rotation direction by an angle $\delta\theta$, and the angular speed of the coupling member 41 is delayed from the angular speed of the comparative drive connecting member 190.

Then, when the comparative drive connecting member 190 is further rotated in arrow F direction in FIG. 26C from the state of FIGS. 26A through 26C, the driven side projection 195 positioned at the upper side in FIG. 26A is moved in the driven side grooves 142 in the axial direction to approach the photoconductor gear 82. Further, the driven side projection 195 positioned at a lower side in FIG. 26A is moved in the driven side grooves 142 in the axial direction in a direction away from the photoconductor gear 82. At this time, the abutting positions of the driven side projections 195 against the driven side groove side surfaces are changed from the top side to the driven side spherical portion sides. When the comparative drive connecting member 190 is rotated by an angle of 90 degrees from the state of FIGS. 26A through 26C and rotated by an angle of 180 degrees in total, a state after the rotation becomes the same as the state of FIGS. 25A through 25C, except that the positions of the driven side projections 195 and the driven side grooves 142 are switched. At this time, the delay of the coupling member 41 is canceled and is rotated by an angle of 180 degrees, similarly to the comparative drive connecting member 190. That is, while the coupling member 41 is rotated by an angle of 90 degrees from the state of FIGS. 26A through 26C, the coupling member 41 is rotated more by the angle $\delta\theta$, and the angular speed becomes faster than the comparative drive connecting member 190. Accordingly, in the case in which the driven side projections have a hemisphere shape, the angular speed variation of a half (½) rotation period is caused.

In the above description, the speed variation between the comparative drive connecting member 190 and the coupling member 41 has been described. However, in a case in which the drive side projections have a hemisphere shape, the comparative drive connecting member 190 has speed variation in a half (½) period between the photoconductor gear 82 and the comparative drive connecting member 190.

Figure 27A:
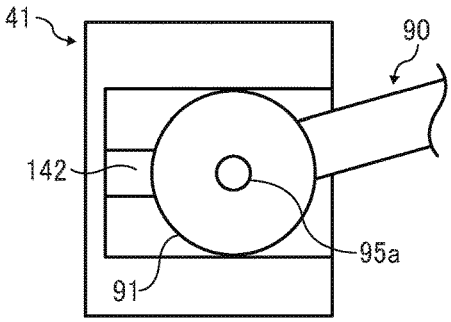
FIGS. 27A, 27B and 27C are diagrams illustrating a drive transmission operation of the drive connecting member and the coupling member of the drive transmission device according to an embodiment of this disclosure.
Figure 27B:
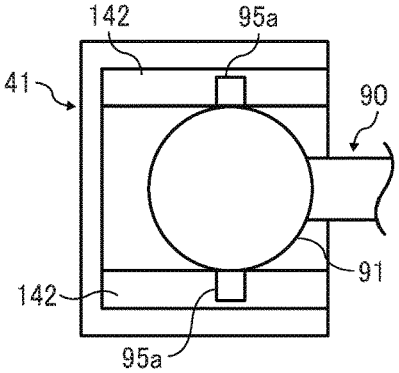
Figure 27C:
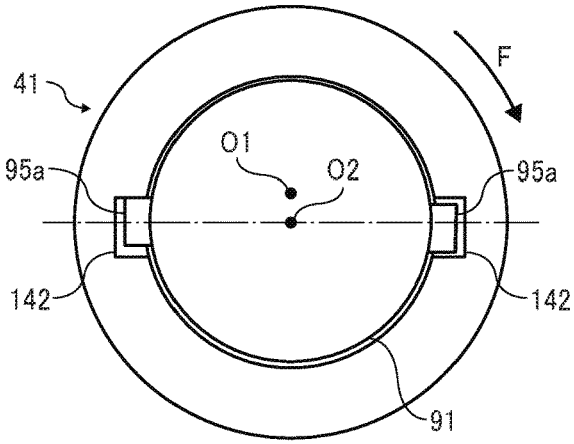
Figure 28A:
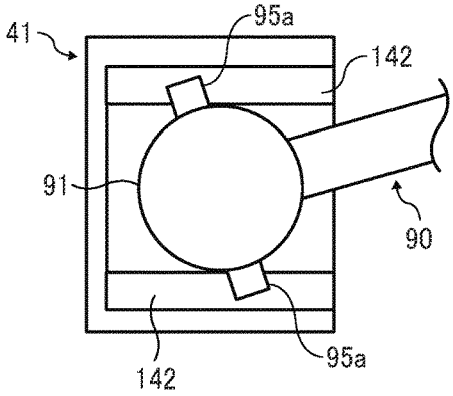
FIGS. 28A, 28B and 28C are diagrams illustrating states in which the drive connecting member and the coupling member of the drive transmission device are rotated by an angle of 90 degrees from the states of FIGS. 27A, 27B and 27C, respectively.
Figure 28B:
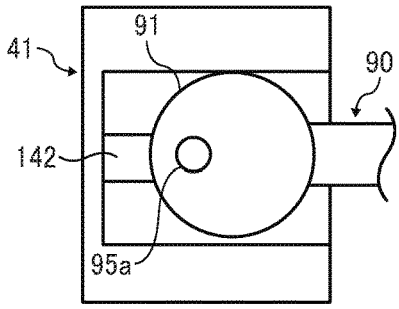
Figure 28C:
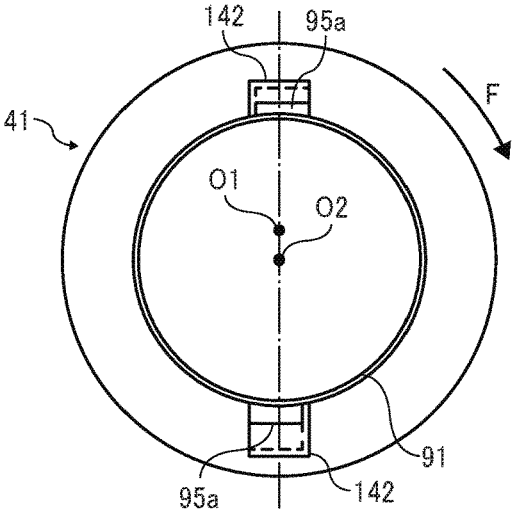

FIGS. 27A, 27B and 27C are diagrams illustrating the drive transmission operation of the drive connecting member 90 and the coupling member 41 according to the present embodiment. Specifically, FIG. 27A is a diagram illustrating the coupling member 41 and the drive connecting member 90, viewed from a direction perpendicular to an angularly shifted direction of the drive connecting member 90. FIG. 27B is a diagram illustrating the coupling member 41 and the drive connecting member 90, viewed from the top of FIG. 27A. FIG. 27C is a diagram illustrating the coupling member 41 and the drive connecting member 90, viewed from the axial direction. FIGS. 28A, 28B and 28C are diagrams illustrating states in which the drive connecting member 90 and the coupling member 41 of the drive transmission device are rotated by an angle of 90 degrees from the states of FIGS. 27A, 27B and 27C, respectively. Specifically, FIG. 28A is a diagram illustrating the coupling member 41 and the drive connecting member 90, viewed from a direction perpendicular to the angularly shifted direction of the drive connecting member 90. FIG. 28B is a diagram illustrating the coupling member 41 and the drive connecting member 90, viewed from the top of FIG. 28A. FIG. 28C is a diagram illustrating the coupling member 41 and the drive connecting member 90, viewed from the axial direction.

It is to be noted that, in FIGS. 27C and 28C, the reference letter "O2" indicates the shaft core of the coupling member 41, and the reference letter "O1" indicates the shifted shaft core.

In the present embodiment, the driven side projections 95*a* have a columnar shape. Accordingly, as illustrated in FIG. 27C, downstream side ends of the rotation direction of the driven side projections 95*a* that function as groove abutting portions to abut against side surfaces of the driven side grooves 142 have a linear shape linearly extending in the radial direction. As a result, the groove abutting portions of the driven side projections 95*a* to abut against the driven side grooves 142 remain at the same positions in the rotation direction from the driven side spherical portion 92 side to the top. When the drive connecting member 90 is rotated in the direction indicated by arrow F in FIG. 27C from the state illustrated in FIGS. 27A through 27C, respective entering amounts of the driven side projections 95*a* to the driven side grooves 142 are decreased. When the drive connecting member 90 is rotated by an angle of 90 degrees, as illustrated in FIG. 28C, the top sides alone of the driven side projections 95*a* enter the driven side grooves 142. As a result, the downstream side ends of the rotation direction at the tops of the driven side projections 95*a* abut against the side surfaces of the driven side grooves 142. However, the downstream side ends of the rotation direction of the driven side projections 95*a* have a linear shape linearly extending in the radial direction. Therefore, even when the downstream side ends alone of the rotation direction at the tops of the driven side projections 95*a* abut against the side surfaces of the driven side grooves 142, the coupling member 41 is rotated by the same angle as the drive connecting member 90 without being delayed from the rotation of the drive connecting member 90. Accordingly, even when the axial misalignment is generated, the coupling member 41 can be rotated at a constant speed.

Similarly, each of the first drive side projection 94*a* and the second drive side projection 94*b* has a columnar shape, and thus the drive connecting member 90 can be rotated at a constant speed without causing the angular speed variation in the drive transmission from the photoconductor gear 82 to the drive connecting member 90 due to the shape of the projections (i.e., the first drive side projection 94*a* and the second drive side projection 94*b*).

Further, in the present embodiment, the first drive side projection 94*a*, the second drive side projection 94*b*, and the driven side projections 95*a* have columnar shapes. By so doing, the downstream end portion of the rotation direction that correspond to groove abutting portions abutting against the side surfaces of the drive side grooves 85 and the driven side grooves 142 have respective arc surfaces protruding in the rotation direction. As a result, as viewed from the radial direction, the abutting between any one of the first drive side projection 94*a*, the second drive side projection 94*b* and the driven side projections 95*a* and a corresponding one of the drive side grooves 85 and the driven side grooves 142 becomes point connection, and the drive connecting member 90 can be smoothly inclined in the direction perpendicular to the protruding direction of the first drive side projection 94*a*, the second drive side projection 94*b*, and the driven side projections 95*a*, as illustrated in FIG. 27A. It is to be noted that the point connection is an ideal state in design, and includes, in reality, a state having some contact width.

Figure 29:
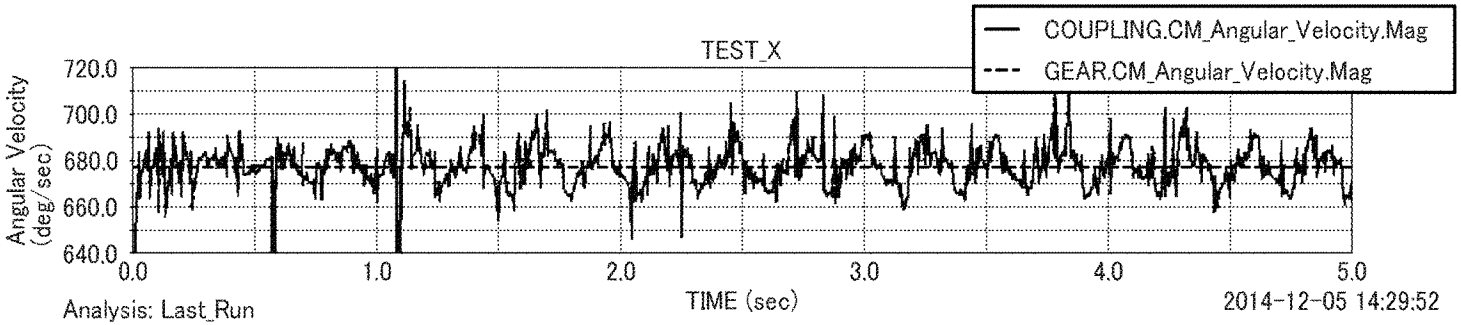
FIG. 29 is a graph illustrating speed variations of a photoconductor drum checked when a shaft center of a drum shaft is shifted from a rotary shaft of a photoconductor gear by a predetermined amount in a comparative configuration in which the drive side projection and the driven side projection have hemisphere shapes.

FIG. 29 is a graph illustrating speed variations of the photoconductor drum 2 checked when an axial center of the photoconductor drum shaft 40*a* is shifted from a rotation shaft of the photoconductor gear 82 by a predetermined amount, using the comparative drive connecting member 190 with the first drive side projection 94*a*, the second drive side projection 94*b* and the driven side projections 95*a* having hemisphere shapes. As illustrated in FIG. 29, the photoconductor drum 2 have speed variations generated at the predetermined cycle.

Figure 30:
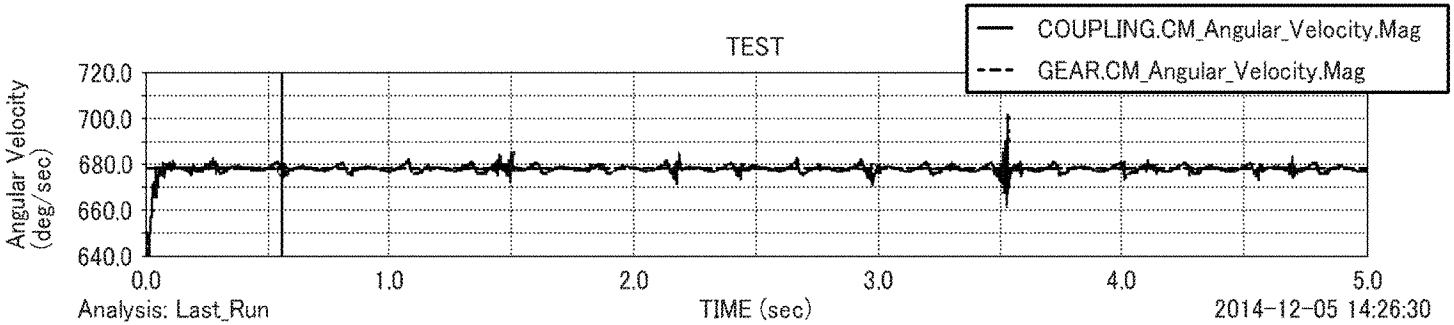
FIG. 30 is a graph illustrating speed variations of a photoconductor drum checked when a shaft center of a drum shaft is shifted from a rotary shaft of a photoconductor gear by a predetermined amount in a configuration according to the present embodiment of this disclosure, in which the drive side projection and the driven side projection have cylindrical shapes.

FIG. 30 is a graph of the speed variations of the photoconductor drum 2 checked when the axial center of the photoconductor drum shaft 40*a* is shifted from the rotation shaft of the photoconductor gear 82 by a predetermined amount, using the drive connecting member 90 of the present embodiment with the first drive side projection 94*a*, the second drive side projection 94*b* and the driven side projections 95*a* having columnar shapes.

As illustrated in FIG. 30, the speed variations of the photoconductor drum 2 are restrained sufficiently, when compared with the comparative configuration having the comparative drive connecting member 190.

Figure 31:
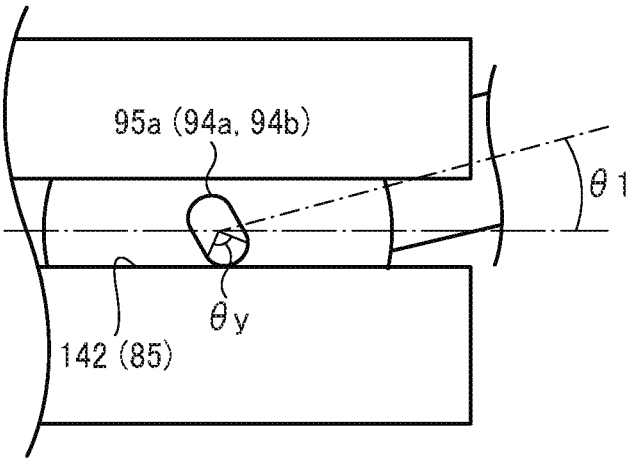
FIG. 31 is a diagram illustrating a variation of the drive side projection and the driven side projection.

Further, the first drive side projection 94*a*, the second drive side projection 94*b* and the driven side projections 95*a* may have any shapes as long as the groove abutting portions at least abutting against the side surfaces of the grooves (i.e. the driven side grooves 142 and the drive side grooves 85) linearly extend in the radial direction and protrude in the rotation direction. Therefore, for example, the first drive side projection 94*a*, the second drive side projection 94*b* and the driven side projections 95*a* may have a columnar shape having a rectangular shape with rounded corners in cross section, or a columnar shape having an elliptical shape in cross section, as illustrated in FIG. 31.

Further, in a case in which the groove abutting portion of the projection (i.e., any one of the first drive side projection 94*a*, the second drive side projection 94*b* and the driven side projections 95*a*), which abuts against the side surface of the groove (i.e., any one of the drive side grooves 85 and the driven side groove 142), has an arc surface, a center angle θy of the arc is set to twice or more the maximum inclination angle θ1 of the drive connecting member 90 in the direction perpendicular to the protruding direction of the projection (i.e., any one of the first drive side projection 94*a*, the second drive side projection 94*b* and the driven side projections 95*a*) of the drive connecting member 90. Therefore, even when the drive connecting member 90 is inclined by the maximum inclination angle θ1, the arc surface of the projection (i.e., any one of the first drive side projection 94*a*, the second drive side projection 94*b* and the driven side projections 95*a*) can abut against the side surface of the groove (i.e., any one of the drive side grooves 85 and the driven side grooves 142). Accordingly, even when the drive connecting member 90 is inclined by the maximum inclination angle θ1, the contact between the groove (i.e., any one of the drive side grooves 85 and the driven side grooves 142) and the projection (i.e., any one of the first drive side projection 94*a*, the second drive side projection 94*b* and the driven side projections 95*a*) as viewed from the protruding direction of the projection (i.e., any one of the first drive side projection 94*a*, the second drive side projection 94*b* and the driven side projections 95*a*) can be the point connection, and the drive connecting member 90 can be smoothly inclined.

Figure 32:
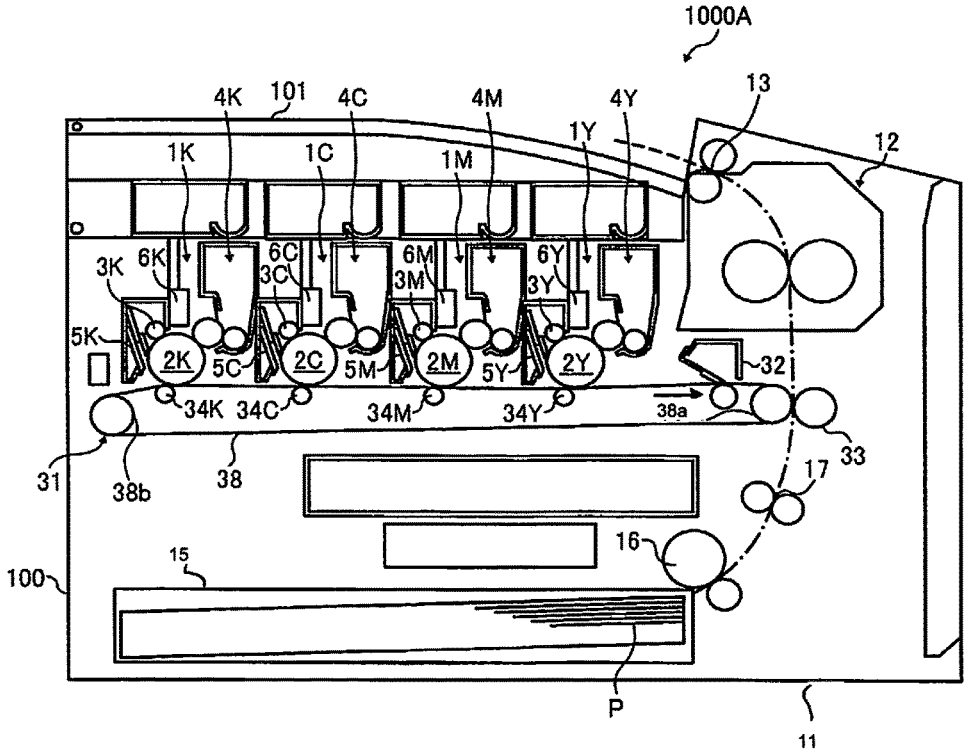
FIG. 32 is a diagram illustrating a schematic diagram of a general image forming apparatus according to an embodiment of this disclosure.
Figure 33:
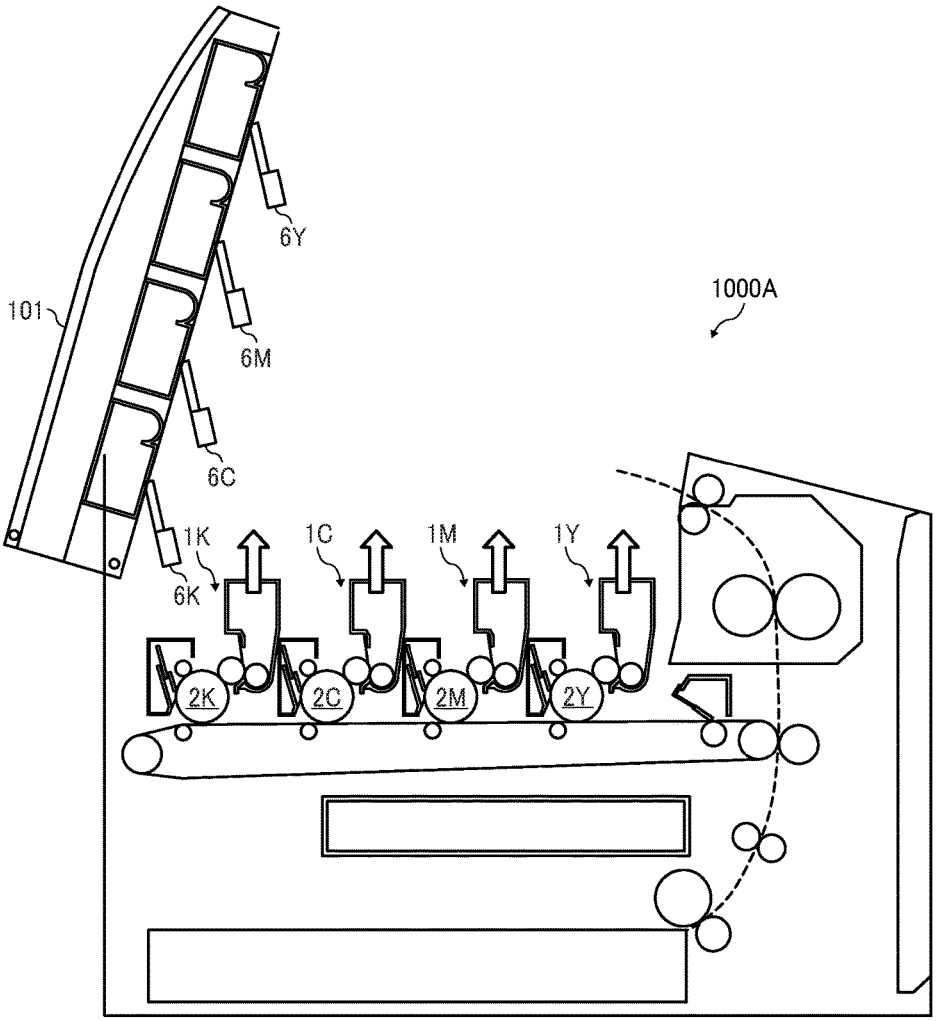
FIG. 33 is a configuration diagram illustrating a state in which a cover of an apparatus body of the image forming apparatus of FIG. 32 is open.

FIG. 32 is a diagram illustrating a schematic diagram of a general image forming apparatus 1000A according to an embodiment of this disclosure. FIG. 33 is a configuration diagram illustrating a state in which an upper cover 101 on top of the apparatus body 100 of the image forming apparatus 1000A of FIG. 32 is open.

As illustrated in FIG. 32, the image forming apparatus 1000A includes four process cartridges 1Y, 1M, 1C and 1K are detachably attached to the apparatus body 100 thereof. The process cartridges 1Y, 1M, 1C and 1K have a basically identical configuration to each other, except that these process cartridges 1Y, 1M, 1C and 1K contain toners of different colors of yellow (Y), magenta (M), cyan (C), and black (K) corresponding to color separation components of a color image.

To be specific, each of the process cartridges 1Y, 1M, 1C and 1K includes photoconductor drums 2Y, 2M, 2C, and 2K, functioning as an image bearer. The process cartridges 1Y, 1M, 1C, and 1K include charging rollers 3Y, 3M, 3C and 3K, which charges respective surfaces of the photoconductor drums 2Y, 2M, 2C and 2K, developing devices 4Y, 4M, 4C and 4K, functioning as developing devices that make respective latent images on the photoconductor drums 2Y, 2M, 2C and 2K into visible toner images, cleaning blades 5Y, 5M, 5C and 5K, which clean the respective surfaces of the photoconductor drums 2Y, 2M, 2C and 2K. The process cartridges 1Y, 1M, 1C and 1K have respective configurations identical to each other except the colors of toners.

The image forming apparatus 1000A further includes light emitting diode (LED) head arrays 6Y, 6M, 6C and 6K disposed near the photoconductor drums 2Y, 2M, 2C and 2K, respectively. The LED head arrays 6Y, 6M, 6C and 6K function as an exposing device to expose the respective surface of the photoconductor drums 2Y, 2M, 2C and 2K, respectively.

A sheet feeding device 11 includes a sheet feed tray 15 and a sheet feed roller 16. The sheet feed tray 15 accommodates the sheet P. The sheet feed roller 16 feeds the sheet P accommodated in the sheet feed tray 15. Further, a pair of registration rollers 17 is disposed downstream from the sheet feed roller 16 in a sheet conveying direction. The pair of registration rollers 17 functions as a pair of timing rollers to convey the sheet P to a transfer nip region at a proper timing of conveyance of the sheet P.

As illustrated in FIG. 32, the image forming apparatus 1000A further includes a fixing device 12, the sheet feed roller 16 and the pair of registration rollers 17. The fixing device 12, the sheet feed roller 16 and the pair of registration rollers 17 included in the image forming apparatus 1000A in FIG. 32 basically function identical to the fixing device 12, the sheet feed roller 16 and the pair of registration rollers 17 included in the image forming apparatus 1000 in FIG. 1. Therefore, redundant descriptions in connection to these parts and devices are summarized or omitted accordingly.

The image forming apparatus 1000A further includes the upper cover 101. As illustrated in FIG. 33, as the upper cover 101 opens, the process cartridges 1Y, 1M, 1C and 1K can be detached from and attached to the apparatus body 100 through an opening area on top.

The image forming apparatus 1000A further includes a transfer device 31 in the apparatus body 100. The transfer device 31 is located below the photoconductor drums 2Y, 2M, 2C and 2K and includes an intermediate transfer belt 38, primary transfer rollers 34Y, 34M, 34C and 34K, and a belt cleaning device 32. The intermediate transfer belt 38 is an endless belt. The primary transfer rollers 34Y, 34M, 34C and 34K are disposed inside the loop of the intermediate transfer belt 38 and facing the photoconductor drums 2Y, 2M, 2C and 2K, respectively, via the intermediate transfer belt 38. The primary transfer rollers 34Y, 34M, 34C and 34K transfer respective single color toner images formed on the photoconductor drums 2Y, 2M, 2C and 2K onto the intermediate transfer belt 38. The belt cleaning device 32 cleans the intermediate transfer belt 38. The intermediate transfer belt 38 is stretched over a drive roller 38*a* and a driven roller 38*b*. The intermediate transfer belt 38 goes around and travels (is rotated) in a direction illustrated by arrow in FIG. 32 as the drive roller 38*a* is rotated in a counterclockwise direction in FIG. 32.

As the respective single color toner images formed on the photoconductor drums 2Y, 2M, 2C and 2K, respectively, are sequentially transferred and overlaid onto the surface of the intermediate transfer belt 38, a full color toner image is formed on the surface of the intermediate transfer belt 38. Then, a secondary transfer roller 33 transfers the full color toner image formed on the surface of the intermediate transfer belt 38 onto a sheet P, so that the full color toner image is formed on the sheet P.

Residual toner remaining on the intermediate transfer belt 38 without being transferred onto the sheet P is removed by the belt cleaning device 32.

The transfer device 31 can be attached to or detached from the apparatus body 100 of the image forming apparatus 1000A while the process cartridges 1Y, 1M, 1C and 1K are detached from the apparatus body 100 of the image forming apparatus 1000A.

In the image forming apparatus 1000A for forming color images, the coupling member 41 and the drive connecting member 90 described above are provided thereto, for each of the photoconductor drums 2Y, 2M, 2C and 2K. The coupling member 41 and the drive connecting member 90 described above are provided for drive connection between respective developing roller shafts of the developing devices 4Y, 4M, 4C and 4K and the drive transmission device.

Figure 34A:
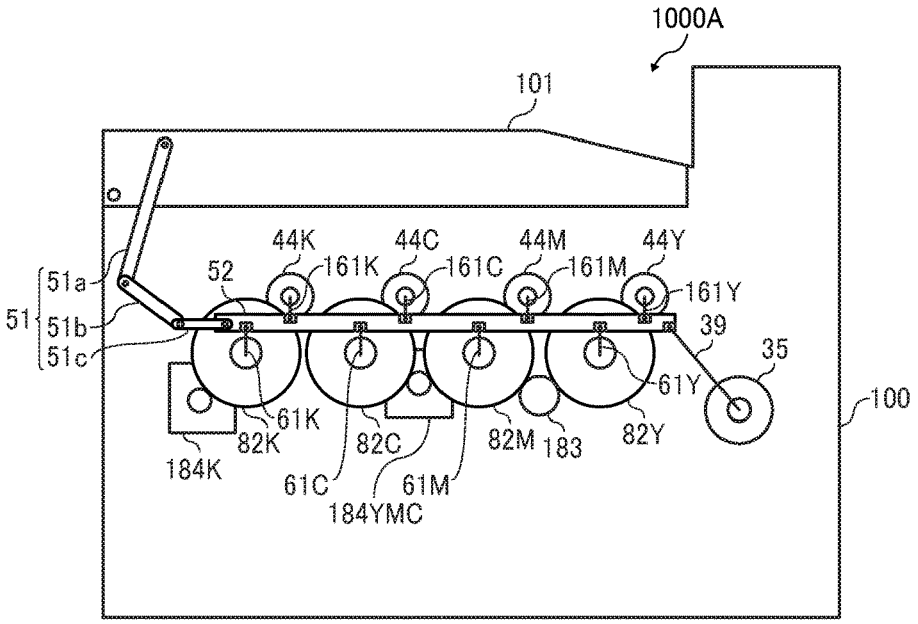
FIGS. 34A and 34B are diagrams illustrating retraction of each drive connecting member in a color image forming apparatus.
Figure 34B:
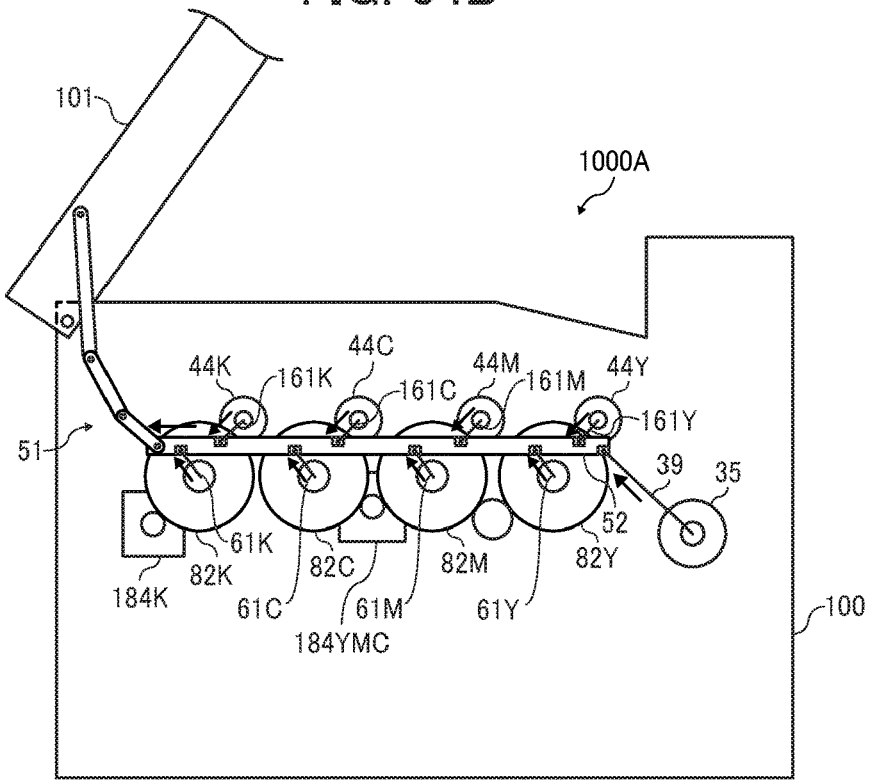

FIGS. 34A and 34B are diagrams illustrating retraction of each drive connecting member 90 in the image forming apparatus 1000A for forming color images.

FIG. 34A is a diagram illustrating the image forming apparatus 1000A with the upper cover 101 closed. FIG. 34B is a diagram illustrating the image forming apparatus 1000A with the upper cover 101 open.

As illustrated in FIG. 34A, the image forming apparatus 1000A includes a drive motor 184YMC to drive a photoconductor gear 82Y for yellow (Y) images, a photoconductor gear 82M for magenta (M) images and a photoconductor gear 82C for cyan (C) images, and a drive motor 184K for a photoconductor gear 82K for black (K) images. A motor gear of the drive motor 184YMC is meshed with the photoconductor gear 82C and the photoconductor gear 82M. An idler gear 183 is provided to mesh with the photoconductor gear 82M and the photoconductor gear 82Y. A motor gear of the drive motor 184K is meshed with the photoconductor gear 82K.

The drive connecting member 90 is provided to each of the photoconductor gears 82Y, 82M, 82C and 82K. A second connecting portion 61*b* of each of wires 61Y, 61M, 61C and 61K is attached to the drive connecting member 90. A first connecting portion 61*a* of each of the wires 61Y, 61M, 61C and 61K is attached to a sliding member 52 disposed slidably in the left and right directions in FIG. 34B.

The drive connecting member 90 illustrated in FIG. 3 is also provided to each of developing roller gears 44Y, 44M, 44C and 44K. Further, the coupling member 41 illustrated in FIG. 3 is mounted on each developing roller shaft of the developing devices 4Y, 4M, 4C and 4K. The second connecting portion 61*b* of each of developing roller wires 161Y, 161M, 161C and 161K is attached to the drive connecting member 90 held by each of the developing roller gears 44Y, 44M, 44C and 44K. The first connecting portion 61*a* of each of the developing roller wires 161Y, 161M, 161C and 161K is attached to the sliding member 52.

Further, the drive connecting member 90 illustrated in FIG. 3 is also provided to a belt gear 35 that transmits a driving force to the drive roller 38*a* that stretches the intermediate transfer belt 38 with tension, so as to rotate and drive the intermediate transfer belt 38. Further, the coupling member 41 illustrated in FIG. 3 is mounted on a roller shaft of the drive roller 38*a*. The second connecting portion 61*b* of a belt wire 39 is attached to the drive connecting member 90 held by the belt gear 35. The first connecting portion 61*a* of the belt wire 39 is attached to the sliding member 52.

The sliding member 52 is connected to a link mechanism 51 formed by three link members 51*a*, 51*b* and 51*c* to be linked with opening and closing of the upper cover 101.

As illustrated in FIG. 34B, as the upper cover 101 is moved to open, the link mechanism 51 pulls the sliding member 52 to the left side in FIG. 34B, so that the sliding member 52 slides toward the left side. The drive connecting members 90 have the respective second connecting portions 61*b*. As the sliding member 52 slides to the left side, the sliding member 52 pulls each of the wires 61Y, 61M, 61C and 61K, the developing roller wires 161Y, 161M, 161C and 161K, and the belt wire 39, each being connected to the second connecting portions 61*b* of the drive connecting members 90. As a result, the respective drive connecting members 90 held by the developing roller gears 44Y, 44M, 44C and 44K and the photoconductor gears 82Y, 82M, 82C and 82K move to the releasing position, so that the connection with the respective drive connecting members 90 and the respective coupling members 41 are cancelled. Accordingly, the process cartridges 1Y, 1M, 1C and 1K are detached from the apparatus body 100 of the image forming apparatus 1000A. Further, as the drive connecting member 90 mounted on the belt gear 35 moves to the releasing position, the transfer device 31 is removed from the apparatus body 100 of the image forming apparatus 1000A.

The configurations according to the above-descried embodiments are not limited thereto. This disclosure can achieve the following aspects effectively.

Aspect 1.

A drive transmission device (for example, the drive transmission device 70) includes a drive connecting body (for example, the drive connecting member 90), a biasing body (for example, the spring 73), and a retracting device (for example, the retraction mechanism 150) including an operating body (for example, the cover 37) and a linear body (for example, the wire 61). The drive connecting body is drivably coupled to a drive connection target body (for example, the coupling member 41) and movably disposed between a drive connecting position at which the drive connecting body transmits a driving force applied by a drive source (for example, the drive motor 184YMC and the drive motor 184K) to the drive connection target body and a retracted position at which the drive connecting body is separated from the drive connection target body. The biasing body is configured to bias the drive connecting body to be located at a drive connecting position. The operating body of the retracting device is operated manually and is configured to cause the drive connecting body to retract from the drive connecting position to the retracted position, in connection to movement of the operating body. One end of the linear body of the retracting device is connected to the operating body and an opposed end of the linear body is connected to the drive connecting body. The operating body causes the opposed end of the linear body to move in a direction opposite a biasing direction of the biasing body.

According to this configuration, the opposed end of the liner body (for example, the wire 61) that is connected to the drive connecting body (for example, the drive connecting member 90) is caused to move in the direction opposite the biasing direction of the biasing body (for example, the spring 73) along with operation of the operating body (for example, the cover 37). Consequently, along with the movement of the operating body, the drive connecting body is caused to move to the retracted position. Accordingly, the drive connecting body is moved to the retracted position without providing a retracting member, and, when compared with the comparative configuration having a retracting member, the number of parts is reduced, and therefore a reduction in cost and space of the image forming apparatus (for example, the image forming apparatus 1000 and the image forming apparatus 1000A) can be achieved.

Aspect 2.

In Aspect 1, the linear body (for example, the wire 61) includes a first connecting portion (for example, the first connecting portion 61*a*) and a second connecting portion (for example, the second connecting portion 61*b*). The first connecting portion is mounted on the one end of the linear body and is connected to the operating body (for example, the cover 37). The second connecting portion is mounted on the opposed end and connected to the drive connecting body (for example, the drive connecting member 90). The second connecting portion is greater in size than the first connecting portion. The drive connecting body includes an opening (for example, the through hole 96*b*) that is formed at an upstream side end of the drive connecting body in the biasing direction of the biasing body, has a diameter smaller than the second connecting portion and greater than the first connecting portion, and causes the linear body to pass therethrough.

According to this configuration, as described in the embodiments above, the first connecting portion is passed through the opening, so that the linear body (for example, the wire 61) is passed through the opening. By so doing, the second connecting portion (for example, the second connecting portion 61*b*) is caught by the edge of the opening, and therefore the second connecting portion can be attached to the drive connecting body (for example, the drive connecting member 90).

Aspect 3.

In Aspect 2, the drive connecting body (for example, the drive connecting member 90) is inclinable to an axial direction thereof. The second connecting portion (for example, the second connecting portion 61*b*) has a spherical shape.

According to this configuration, as described in the above-described embodiment, the drive connecting body (for example, the drive connecting member 90) is inclined smoothly without being caught by the second connecting portion.

Aspect 4.

In any one of Aspect 1 through Aspect 3, the operating body (for example, the cover 37) includes a connected portion (for example, the wire attaching device 130) to which the one end of the linear body (for example, the wire 61) is connected. The connected portion includes a linear body biasing body (for example, the tension spring 132)

configured to bias the one end of the linear body in the direction opposite the biasing direction of the biasing body (for example, the spring 73).

According to this configuration, as described in the above-described embodiments with reference to FIG. 22, the linear body (for example, the wire 61) is prevented from being loosen or slack, and therefore a failure such as the linear body being caught by a part in the drive transmission device can be restrained from occurring.

Aspect 5.

In Aspect 5, an image forming apparatus (for example, the image forming apparatus 1000 and the image forming apparatus 1000A) includes an image bearer (for example, the photoconductor drum 2) configured to bear an image formed thereon and the drive transmission device (for example, the drive transmission device 70) according to any one of Aspect 1 through Aspect 4. The drive transmission device is configured to transmit a driving force applied by the drive source (for example, the drive motors 184YMC and 184K) to the image bearer.

According to this configuration, a reduction in size of the image forming apparatus can be achieved.

Aspect 6.

In Aspect 5, the operating body is a cover (for example, the cover 37) disposed openably closable to an apparatus body (for example, the apparatus body 100) of the image forming apparatus (for example, the image forming apparatus 1000 and the image forming apparatus 1000A).

According to this configuration, opening of the cover can cause the drive connecting body (for example, the drive connecting member 90) to retract from the drive coupling position to the retracted position. Accordingly, when compared with the configuration in which the operating body is retracted from the drive coupling position to the retracted position, the workload of the drive connecting body (for example, the drive connecting member 90) can be reduced when moving from the drive coupling position to the retracted position.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A drive transmission device comprising:

an apparatus body;

a drive connecting body drivably coupled to a drive connection target body and movably disposed between a drive connecting position at which the drive connecting body transmits a driving force applied by a drive source to the drive connection target body and a retracted position at which the drive connecting body is separated from the drive connection target body;

a biasing body configured to bias the drive connecting body to be located at the drive connecting position; and a retracting device including:

an operating body operated manually and configured to cause the drive connecting body to retract from the drive connecting position to the retracted position, in connection to movement of the operating body; and a linear body, one end of which connected to the operating body and an opposed end of which connected to the drive connecting body, the operating body causing the opposed end of the linear body to move in a direction opposite a biasing direction of the biasing body.

2. The drive transmission device according to claim 1, wherein the linear body includes a first connecting portion mounted on the one end and connected to the operating body, and a second connecting portion mounted on the opposed end and connected to the drive connecting body, wherein the second connecting portion is greater in size than the first connecting portion, and wherein the drive connecting body includes an opening formed at an upstream side end of the drive connecting body in the biasing direction of the biasing body, having a diameter smaller than the second connecting portion and greater than the first connecting portion, and causing the linear body to pass therethrough.

3. The drive transmission device according to claim 2, wherein the drive connecting body is inclinable to an axial direction thereof, and wherein the second connecting portion has a spherical shape.

4. The drive transmission device according to claim 1, wherein the operating body includes a connected portion to which the one end of the linear body is connected, and wherein the connected portion includes a linear body biasing body configured to bias the one end of the linear body in the direction opposite the biasing direction of the biasing body.

5. An image forming apparatus comprising:

an image bearer configured to bear an image formed thereon; and the drive transmission device according to claim 1, configured to transmit a driving force applied by the drive source to the image bearer.

6. The image forming apparatus according to claim 5, wherein the operating body is a cover disposed openably closable to an apparatus body thereof.

* * * * *